US012601102B2

(12) United States Patent
Hahm et al.

(10) Patent No.: US 12,601,102 B2
(45) Date of Patent: Apr. 14, 2026

(54) CLOTHING PROCESSING DEVICE INCLUDING HEAT DISSIPATION SHEET

(71) Applicant: SAMSUNG ELECTRONICS CO., LTD., Suwon-si (KR)

(72) Inventors: Jungyoon Hahm, Suwon-si (KR); Donggeun Park, Suwon-si (KR); Songjae Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 133 days.

(21) Appl. No.: 18/762,241

(22) Filed: Jul. 2, 2024

(65) Prior Publication Data

US 2024/0352652 A1 Oct. 24, 2024

Related U.S. Application Data

(63) Continuation of application No. PCT/KR2023/000703, filed on Jan. 13, 2023.

(30) Foreign Application Priority Data

Feb. 16, 2022 (KR) ..... 10-2022-0020046

(51) Int. Cl.

| | |
|---|---|
| ***D06F 39/14*** | (2006.01) |
| ***D06F 37/04*** | (2006.01) |
| ***D06F 37/42*** | (2006.01) |

(52) U.S. Cl.

CPC ..... *D06F 39/14* (2013.01); *D06F 37/42* (2013.01); *D06F 37/04* (2013.01)

(58) Field of Classification Search

None

See application file for complete search history.

(56) References Cited

U.S. PATENT DOCUMENTS

2006/0289533 A1* 12/2006 Park ..... D06F 39/12 219/757
2009/0217545 A1* 9/2009 Banicevic ..... D06F 34/28 312/228

(Continued)

FOREIGN PATENT DOCUMENTS

JP 2000-14997 1/2000
JP 2009-220400 10/2009

(Continued)

OTHER PUBLICATIONS

International Search Report dated Apr. 11, 2023 issued in PCT Application No. PCT/KR2023/000703.

(Continued)

*Primary Examiner* — Omair Chaudhri
(74) *Attorney, Agent, or Firm* — STAAS & HALSEY LLP

(57) ABSTRACT

A clothing processing device comprises a cabinet, a front panel including a first surface, a second surface, and an opening, a drum inside the cabinet to communicate with the opening, and a door connected to the first surface. The front panel includes a seating groove protruding toward the inside of the cabinet along a circumference of the opening to seat the door in response to closing the opening by the door, and an extension surface extending toward the inside of the cabinet from an upper part of the front panel. The extension surface includes curved nose to form a gap with the seating groove, and the clothing processing device includes an insulation between the curved nose and the seating groove, and a heat dissipation sheet attached to the second surface to enclose at least a part of the insulation along the circumference of the insulation.

20 Claims, 13 Drawing Sheets

(56) References Cited

U.S. PATENT DOCUMENTS

| | | | | |
|---|---|---|---|---|
| 2013/0185914 | A1* | 7/2013 | Kang | D06F 39/12 29/428 |
| 2017/0233927 | A1 | 8/2017 | Lee | |
| 2020/0077542 | A1* | 3/2020 | Martin | D06F 39/12 |
| 2020/0149212 | A1* | 5/2020 | Kim | D06F 39/14 |
| 2020/0375019 | A1* | 11/2020 | Kwon | H05K 5/0095 |
| 2021/0176891 | A1* | 6/2021 | Lee | D06F 34/08 |
| 2023/0403805 | A1* | 12/2023 | Maricar | D06F 34/08 |
| 2024/0003613 | A1* | 1/2024 | Hong | F25D 27/00 |

FOREIGN PATENT DOCUMENTS

| | | | | | |
|---|---|---|---|---|---|
| JP | 2011-147693 | | 8/2011 | | |
| JP | 2012-202615 | | 10/2012 | | |
| KR | 20-0264872 | | 2/2002 | | |
| KR | 200264872 | Y1 * | 2/2002 | | |
| KR | 20060053422 | A * | 5/2006 | | D06F 58/20 |
| KR | 20060085791 | A * | 7/2006 | | D06F 34/30 |
| KR | 10-2006-0104623 | | 10/2006 | | |
| KR | 100638945 | B1 * | 10/2006 | | D06F 39/12 |
| KR | 10-2010-0031224 | | 3/2010 | | |
| KR | 10-2013-0071461 | | 6/2013 | | |
| KR | 10-2015-0011043 | | 1/2015 | | |
| KR | 20150011043 | A * | 1/2015 | | D06F 37/22 |
| KR | 20180090003 | A * | 8/2018 | | D06F 33/02 |
| KR | 20210009689 | A * | 1/2021 | | D06F 39/14 |
| WO | WO-2019219069 | A1 * | 11/2019 | | D06F 37/26 |

OTHER PUBLICATIONS

Written Opinion dated Apr. 11, 2023 issued in PCT Application No. PCT/KR2023/000703.

* cited by examiner

CLOTHING PROCESSING DEVICE INCLUDING HEAT DISSIPATION SHEET

CROSS REFERENCE TO THE RELATED APPLICATION

This application is a Continuation application, filed under 35 U.S.C. § 111 (a), of International Application PCT/KR2023/000703 filed Jan. 13, 2023, and is based on and claims priority under 35 U.S.C. § 119 TO Korean Patent Application No. 10-2022-0020046, filed on Feb. 16, 2022, in the Korean Intellectual Property Office, the disclosures of which are incorporated by reference herein in their entireties.

TECHNICAL FIELD

The various embodiments in the present disclosure relate to a clothing processing device including a heat dissipating sheet.

BACKGROUND ART

A clothing processing device may be a device for performing various tasks, for example, washing, drying, deodorizing, or removing wrinkles, and may be, for example, a washing machine or a dryer.

A washing machine, which is one of various clothing processing devices, may be a machine for automatically washing laundry, such as clothing, by using electricity and may be configured to perform washing, rinsing, draining, and spin-dry operations in response to an operation input by a user.

In general, the washing machine may be a device including a tub containing a predetermined amount of water and a drum rotatably installed in the tub and may perform each wash operation as the drum containing laundry rotates in the tub by the driving of a drive device.

DISCLOSURE OF THE INVENTION

Technical Solutions

A front panel of the clothing processing device may be overheated during some operations that heat the inside of the drum, wherein the front panel is disposed on a front surface of the drum. For example, when the clothing processing device performs a dry operation, a spray nozzle connected to a heat exchanger may spray hot and dry air to the inside of the drum, and as the inside of the drum is heated, heat may be transferred to a front panel of a cabinet communicating with the drum, and the front panel may be overheated.

A partial area between a groove structure in which the door is disposed in the front panel and the upper side surface of the front panel may be intensively overheated compared to other areas in the front panel because hot air in the drum ascends and stays in the partial area.

When the user's body is in contact with an overheated front panel, the user may be burned or injured. Specifically, since an upper partial area of the front panel is adjacent to a control panel and is placed in a position that may be easily in contact with the user's body, efficient heat dissipation is needed.

Accordingly, in the front panel, a groove structure in which a door is placed and a nose structure in which an upper surface is curved to maintain a predetermined gap with the top surface of the front panel may be formed, and an insulator and/or a heat dissipating sheet may be provided to prevent overheating between the nose structure and the groove structure.

The technical goals to be achieved through example embodiments of the present disclosure are not limited to those described above, and other technical goals not mentioned above are clearly understood by one of ordinary skill in the art from the following description.

The clothing processing device in one embodiment of the present disclosure may include a cabinet, a front panel including a first surface that forms a front surface of the cabinet, a second surface that is opposite to the first surface, and an opening formed therein and extending from the first surface to the second surface, a drum disposed in the cabinet and to communicate with the opening, and a door connected to the first surface of the front panel to open or close the opening, wherein the front panel may include a seating groove protruding toward an inside the cabinet along a circumference of the opening such that the door is placed on the seating groove in response to closing the opening by the door and an extended surface extending to the inside the cabinet from an upper end of the front panel, wherein the extended surface may include a curved nose to form a gap with the seating groove, and wherein the clothing processing device may include an insulator disposed between the curved nose and the seating groove in the second surface of the front panel and a heat dissipating sheet attached to the second surface of the front panel to enclose at least a portion of the insulator along a circumference of the insulator.

The heat dissipating sheet may comprises: a first sheet area disposed between the insulator; and at least one of a left end of the second surface and a right end of the second surface.

The first sheet area may comprise: a first left sheet area disposed between the insulator and the left end of the second surface, and a first right sheet area disposed between the insulator and the right end of the second surface.

One end of the first sheet area may be substantially in contact with the insulator.

An other end that is opposite to the one end of the first sheet area may be substantially in contact with one of the left end of the second surface and the right end of the second surface.

The heat dissipating sheet may comprise a second sheet area disposed between the insulator and the opening to attach at least a partial area of the second sheet area to the seating groove.

The second sheet area may extend along the seating groove to enclose at least a portion of the opening along the circumference of the opening.

The seating groove may comprise a flat portion that is substantially flat and an inclined portion that protrudes from the second surface to connect to the flat portion, and the second sheet area comprises: a flat sheet portion attached to the flat portion; and an inclined sheet portion attached to the inclined portion.

The heat dissipating sheet may further comprise: a third sheet area disposed between the second sheet area and at least one of the left end of the second surface and the right end of the second surface.

The third sheet area may comprise: a third left sheet area disposed between the second sheet area and the left end of the second surface; and a third right sheet area disposed between the second sheet area and the right end of the second.

The heat dissipating sheet may further comprise: a first extended area extending from at least one of a left end of the third sheet area and a right end of the third sheet area in a lower direction of the second surface.

The heat dissipating sheet may further comprise: a second extended area extending from the first extended area in a direction in which the opening is enclosed.

The insulator may comprise: a first thermal insulating area disposed on the second surface to be substantially in parallel with the second; and a second thermal insulating area disposed on at least one of the seating groove and the curved nose.

The second thermal insulating area may comprise: an upper thermal insulating area disposed in the curved nose; and a lower thermal insulating area disposed on the seating groove.

The curved nose may comprise a heat dissipating hole to allow air between the curved nose and the seating groove to move to an outside, and the upper thermal insulating area is formed not to overlap the heat dissipating hole.

The door may comprise: a front frame forming a front surface; a rear frame forming a rear surface, the rear frame comprising: a door glass protruding toward the inside the cabinet; and a heat dissipating film disposed between the front frame and the rear frame.

The heat dissipating sheet may be formed of a thermally conductive material to diffuse heat between the curved nose and the seating groove to another area in the front panel.

The heat dissipating sheet may comprise: a thermal conductive layer formed of a thermally conductive material; and an adhesive layer that attaches the thermal conductive layer to the front panel.

The heat dissipating sheet may be formed in a multi-layer structure in which a plurality of thermal conductive layers is stacked.

The insulator may be formed in a multi-layer structure in which a plurality of insulating layers formed of an insulating material is stacked.

Effects of the Invention

According to various embodiments, a clothing processing device may dispose an insulator in a specific portion to prevent the specific portion from overheating, may attach a heat dissipating sheet to a front panel along a circumference of the insulator to diffuse heat in a corresponding portion, and may prevent the front panel from overheating.

In addition, according to various embodiments, a safety problem of a user may be prevented in advance by preventing overheating of the front panel.

BEST MODE FOR CARRYING OUT THE INVENTION

Figure 1:
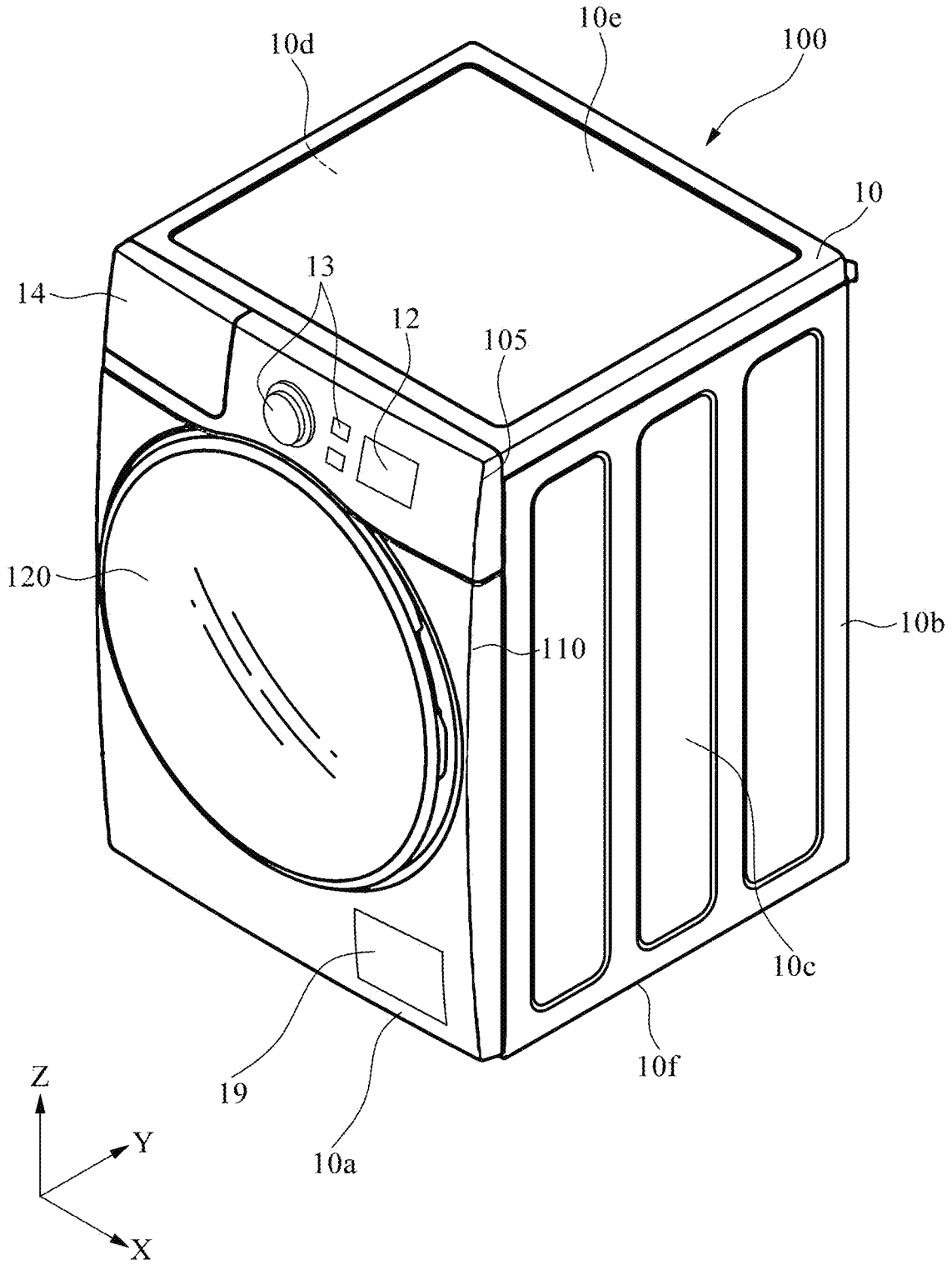
FIG. 1 is a perspective view of a clothing processing device according to one embodiment of the present disclosure.

Hereinafter, embodiments will be described in detail with reference to the accompanying drawings. When describing the embodiments with reference to the accompanying drawings, like reference numerals refer to like components, and any repeated description related thereto will be omitted.

It should be appreciated that embodiments of the disclosure and the terms used therein are not intended to limit the technological features set forth herein to particular embodiments and include various changes, equivalents, or replacements for a corresponding embodiment. In connection with the description of the drawings, like reference numerals may be used for similar or related components. It is to be understood that a singular form of a noun corresponding to an item may include one or more of the things, unless the relevant context clearly indicates otherwise. As used herein, "A or B," "at least one of A and B," "at least one of A or B," "A, B or C," "at least one of A, B and C," and "at least one of A, B, or C," may include any one of the items listed together in the corresponding one of the phrases, or all possible combinations thereof. Terms such as "1st" and "2nd," or "first" and "second" may be used to simply distinguish a corresponding component from other components, and do not limit the components in other aspects (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., by wire), wirelessly, or via a third element.

As used in connection with embodiments of the disclosure, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to one embodiment, the module may be implemented in a form of an application-specific integrated circuit (ASIC).

Embodiments of the present disclosure as set forth herein may be implemented as software (e.g., a program) including one or more instructions that are stored in a storage medium (e.g., an internal memory or an external memory) that is readable by a machine (e.g., an electronic device). For example, a processor of the machine (e.g., an electronic device) may invoke at least one of the one or more instructions stored in the storage medium, and execute it. This allows the machine to be operated to perform at least one function according to the at least one instruction invoked. The one or more instructions may include code generated by a compiler or code executable by an interpreter. The machine-readable storage medium may be provided in the form of a non-transitory storage medium. Here, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to one embodiment, a method according to one embodiment of the disclosure may be included and provided in a computer program product. The computer program product may be traded as a product between a seller and a buyer. The computer program product may be distributed in the form of a machine-readable storage medium (e.g., a compact disc read-only memory (CD-ROM)), or be distributed (e.g., downloaded or uploaded) online via an application store (e.g., PlayStore™), or between two user devices (e.g., smartphones) directly. If distributed online, at least part of the computer program product may be temporarily generated or at least temporarily stored in the machine-readable storage medium, such as memory of the manufacturer's server, a server of the application store, or a relay server.

According to embodiments, each component (e.g., a module or a program) of the above-described components may include a single entity or multiple entities, and some of the multiple entities may be separately disposed in different components. According to embodiments, one or more of the above-described components may be omitted, or one or more other components may be added. Alternatively or additionally, a plurality of components (e.g., modules or programs) may be integrated into a single component. In such a case, according to various example embodiments, the integrated component may still perform one or more functions of each of the plurality of components in the same or similar manner as they are performed by a corresponding one of the plurality of components before the integration. According to embodiments, operations performed by the module, the program, or another component may be carried out sequentially, in parallel, repeatedly, or heuristically, or one or more of the operations may be executed in a different order or omitted, or one or more other operations may be added.

Hereinafter, a detailed description of a clothing processing device including a heat dissipating sheet according to various embodiments of the present disclosure is provided with reference to FIGS. 1 to 8B.

FIG. 1 is a perspective view of a clothing processing device 100 according to one embodiment of the present disclosure.

Referring to FIG. 1, the clothing processing device 100 in one embodiment may include a cabinet 10.

In one embodiment, the clothing processing device 100 may be an apparatus for managing or cleaning clothing and may be, for example, washing machine, a dryer, or a clothing care apparatus. Hereinafter, the washing machine is described as an example of the clothing processing device 100. However, the actual implementation is not limited thereto and various types of clothing processing devices 100 may be implemented.

In one embodiment, the clothing processing device 100 may refer to a device that washes laundry using water and detergent and perform spin-dry on wet laundry. In addition, according to one embodiment, the clothing processing device 100 may perform dry on laundry on which spin-dry is performed.

In one embodiment, the clothing processing device 100 may be divided into a top-loading type in which a door 120 that opens and closes an opening (e.g., an opening 11 of FIG. 2) through which clothing is mainly input is provided at an upper part of the cabinet 10 and a rotation axis of a tub (e.g., a tub 15 of FIG. 2) is perpendicular to the ground, a front-loading type in which the opening 11 is provided on the front surface of the cabinet 10 and the rotation axis of the tub 15 is horizontal to the ground, and a hybrid type, which is a combination thereof. The top-loading type washing machine may also be referred to as "normal washing machine" or "top-loader washing machine", and the front-loading type washing machine may also be referred to as "drum washing machine". Although FIG. 1 illustrates the front-loading type drum washing machine, the clothing processing device 100 in various embodiments is not limited thereto and applied.

In one embodiment, the cabinet 10 may form an external figure of the clothing processing device 100 and may accommodate components of the clothing processing device 100. The cabinet 10 may include a front surface 10*a* on which the opening 11 and the door 120 are provided and which accommodates clothing, a rear surface 10*b* that is opposite to the front surface 10*a*, and a plurality of side surfaces 10*c*, 10*d*, 10*e*, and 10*f* extending from the front surface 10*a* to the rear surface 10*b*. In various embodiments, when viewing the door 120, the plurality of side surfaces 10*c*, 10*d*, 10*e*, and 10*f* may include a right side surface 10*c* and a left side surface 10*d* respectively facing the right and left directions (e.g., the + and −X directions) and the plurality of side surfaces 10*c*, 10*d*, 10*e*, and 10*f* may include a lower side surface 10*f*, which is in contact with the outside or a bottom surface and supports the cabinet 10, and an upper side surface 10*e* that is opposite to the lower side surface 10*f*.

In one embodiment, a front panel 110 may be coupled to the front panel 10*a* of the cabinet 10 and the opening 11 through which laundry is inserted into or removed from the cabinet 10 may be provided in the front panel 110. The door 120 may be connected to the front panel 110 to open and close the opening 11. The clothing processing device 100 may receive laundry in a drum (e.g., the drum 20 of FIG. 2) of the tub 15 disposed therein through the opening 11.

In one embodiment, the clothing processing device 100 may include the front panel 110 that forms the front surface 10*a* of the cabinet 10 and is coupled to the door 120. The front panel 110 may be a component of the cabinet 10 or may be a panel structure coupled to the cabinet 10.

In one embodiment, an auxiliary door 19 may be provided in the front panel 110. For example, when the auxiliary door 19 is open, a specific component, such as a filter (not shown) of the clothing processing device 100, may be exposed to the outside of the cabinet 10 and the user may manage and replace it. Alternatively, when the auxiliary door 19 is open, hot and dry air may be transferred to a space in which the clothing processing device 100 is installed through a heat exchanger (e.g., a heat exchanger 69 of FIG. 3) and a fan (not shown) of the clothing processing device 100, and the space in which the clothing processing device 100 is installed may be dehumidified. In various embodiments, the front panel 110 and the door 120 of the clothing processing device 100 are further described with reference to FIG. 4 and below.

In one embodiment, a control panel 105 may be connected to the front surface 10*a* of the cabinet 10. The control panel 105 may be disposed on an upper end of the front panel 110.

In one embodiment, a plurality of buttons that a user may manipulate and an input device 13, such as a rotating lever, may be provided in the control panel 105. The input device 13 may be an input module (e.g., an input interface 74 of FIG. 3) to receive a user command for the clothing processing device 100.

In one embodiment, the control panel 105 may include a display area 12 for displaying information related to the clothing processing device 100 and laundry. The display area 12 may be a display (e.g., a display 71 of FIG. 3) and may display a control screen or an operation state of the clothing processing device 100 to the user.

In one embodiment, a detergent accommodation portion 14 of the clothing processing device 100 may provide detergent or fabric softener to the tub 15. The detergent accommodation portion 14 may transmit detergent to the drum 20 during a process of supplying wash water. For example, when a water supply valve (e.g., a water supply valve 63 of FIG. 2) is open and water is supplied to a water supply pipe (e.g., a water supply pipe 30 of FIG. 2), water may be provided to the detergent accommodation portion 14 and the detergent or fabric softener accommodated in the detergent accommodation portion 14 may be mixed with water. Accordingly, the water mixed with the detergent or fabric softener may be supplied to the tub 15.

Figure 2:
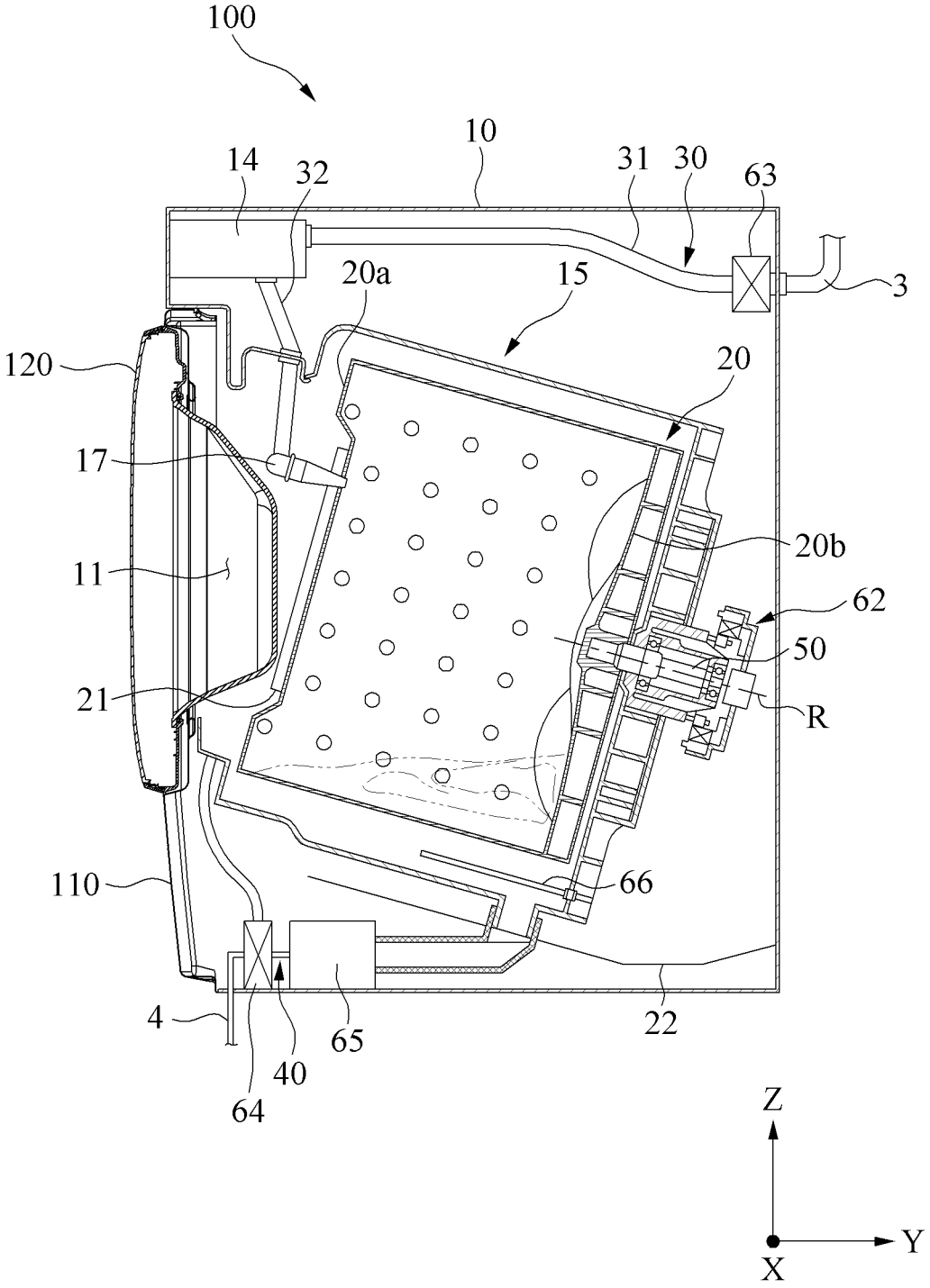
FIG. 2 is a cross-sectional view of a clothing processing device according to one embodiment of the present disclosure.

FIG. 2 is a cross-sectional view of the clothing processing device 100 according to one embodiment of the present disclosure.

Referring to FIG. 2, the clothing processing device 100 may include at least a portion of the tub 15, the drum 20, the water supply pipe 30, and a drain pipe 40.

In one embodiment, the tub 15 may be provided inside the cabinet 10 of the clothing processing device 100 and may be formed in a cylindrical shape of which one surface is open through the opening 11 of the front panel 110. The tub 15 may store a predetermined amount of water required for washing. A lower end of the cabinet 10 may include a water storage 22 in which washing water leaking from the tub 15 is stored without leaking to the outside.

In one embodiment, the tub 15 may be installed at a predetermined angle relative to an installation surface (e.g., a horizontal surface) of the clothing processing device 100 such that a front surface portion of the tub 15 in the cabinet 10 is positioned higher than a rear surface portion of the tub 15.

In detail, the tub 15 may be installed such that a front surface portion 20*a* of the drum 20 has a higher position than a rear surface portion 20*b* of the drum 20, in other words, to have a preset angle (e.g., 5 degrees, 15 degrees, or 30 degrees) based on the horizontal surface. However, this is an example and the front surface portion 20*a* and the rear surface portion 20*b* of the drum 20 may be installed to have a non-tilting angle (e.g., 0 degrees).

In one embodiment, the drum 20 may be installed inside the tub 15 at the same angle as a water tank. In this case, the front surface portion of the drum 20 may refer to a front surface in which an opening formed in the same direction as the opening 11 of the cabinet 10 is formed to load laundry therein, and the rear surface portion may refer to a surface that is opposite to the front portion. Alternatively, the tub 15 may be disposed not to be tilted and a rotation axis of the drum 20 may be provided in a horizontal direction to the ground.

In one embodiment, the drum 20 may be installed in the tub 15, may be substantially implemented as a cylindrical shape, and may form a space for accommodating loaded laundry and washing laundry. An opening corresponding to the opening 11 of the front panel 110 may be provided on the front surface of the drum 20 and when the door 120 is open, laundry may be loaded to the drum 20 through the opening 11.

In one embodiment, a plurality of through holes may be formed in the drum 20 and washing water in the drum 20 may be discharged through the plurality of through holes and may be drained into an external drain pipe 4. For example, during a water supply operation of the clothing processing device 100, washing water supplied from an external water supply pipe 3 may be supplied to the inside the tub 15 through a nozzle connected to the water supply pipe 30. During a spin-dry operation of the clothing processing device 100, the drum 20 may rotate at high speed by a motor assembly (e.g., a motor of FIG. 3) of a drive device 62, washing water in the drum 20 may leak to the outside of the drum 20 through the plurality of through holes of the drum 20 by a centrifugal force of rotation of the drum 20, and washing water accommodated in a space between an outer wall of the drum 20 and an inner wall of the tub 15 may be drained to the external drain pipe 4 through the drain pipe 40.

In one embodiment, the drum 20 may be connected to a shaft 50 and may rotate based on a rotation axis R. The rotation revolutions per minute (RPM) of the drum 20 may vary depending on the purpose of the clothing processing device 100, an operation in progress, and the performance of the motor of the drive device 62, and for example, the drum 20 may rotate 1000 to 3000 times per minute.

In one embodiment, the drive device 62 for rotating the drum 20 and the shaft 50 may be installed in the rear surface portion of the tub 15. The tub 15 may further include a suspension device (not shown) to attenuate vibration generated during the rotation of the drum 20. When the drum 20 rotates by the drive device 62, dirt from the laundry loaded inside the drum 20 may be removed from the laundry while being rubbed with water stored in the tub 15.

In one embodiment, a spray nozzle 17 may be disposed adjacent to an inlet area 21 of the drum 20 and the spray nozzle 17 may be connected to the water supply pipe 30 to supply washing water to the drum 20. The drain pipe 40 for draining washing water may be connected to one side of the lower part of the tub 15. The washing water may refer to typical water, but may also refer to a mixture that further includes detergent or a contaminant other than water. In various embodiments, the spray nozzle 17 may spray washing water in the direction of the front surface portion 20*a* of the drum 20 from the rear surface of the door 120.

In one embodiment, the shaft 50 of a driver 60 installed in the rear surface portion of the tub 15 may be coupled to the rear surface portion 20*b* of the drum 20. The drum 20 may receive power (e.g., a rotational force) generated by a motor of the driver 60 through the shaft 50 and may rotate in an axis direction of the rotation axis R.

In one embodiment, the clothing processing device 100 may include the water supply pipe 30 to supply water to the tub 15 and the drum 20. The water supply pipe 30 may be connected to the external water supply pipe 3 of a faucet and may include the water supply valve 63 that opens and closes the water supply pipe 30. The water supply pipe 30 may connect the external water supply pipe 3 to the tub 15 or the drum 20 and may be a connected flow path to supply washing water to the tub 15 or the drum 20 from the external water supply pipe 3. A pair of the water supply pipes 30 may be provided to supply cold and hot water.

In one embodiment, the detergent accommodation portion 14 may supply detergent to the drum 20 and the detergent may be transmitted to the drum 20 by the water supply pipe 30. For example, the water supply pipe 30 may supply, to the drum 20, detergent contained in the detergent accommodation portion 14 together with washing water as the washing water supplied from the external water supply pipe 3 passes through the detergent accommodation portion 14. The detergent accommodation portion 14 may include a detergent supply valve (e.g., a detergent supply valve 68 of FIG. 3) that opens and closes the detergent accommodation portion 14 and a second water supply pipe 32 that connects between the detergent accommodation portion 14 and the drum 20, and may control detergent supplied to the drum 20.

In one embodiment, the drain pipe 40 may connect the tub 15 to the external drain pipe 4 and may refer to a connected flow path to drain washing water contained in the drum 20 to the external drain pipe 4. The drain pipe 40 may be connected to a pump 65 that flows the washing water of the drum 20 and a drain valve 64 that opens or closes to drain or maintain the washing water of the drum 20. A processor 80 may control the pump 65 and the drain valve 64 to drain the washing water of the drum 20 to the outside or to be circulated in the drum. When the drain valve 64 is closed and the pump 65 is operated to control the washing water to be circulated, fluidity of the washing water in the drum 20 may increase and the washing performance may be improved as the washing water is evenly distributed to the laundry.

In one embodiment, the driver 60 may drive the overall operation of the clothing processing device 100. The driver 60 may rotate the drum 20 or a pulsator (not shown) and may drive the heat exchanger 69 or the heater 66. The clothing processing device 100 may perform a plurality of unit operations of the clothing processing device 100 through the driver 60 by receiving an input signal from the user. The plurality of unit operations may include a water supply operation, a wash operation, a rinse operation, a spin-dry operation, or a drain operation.

Figure 3:
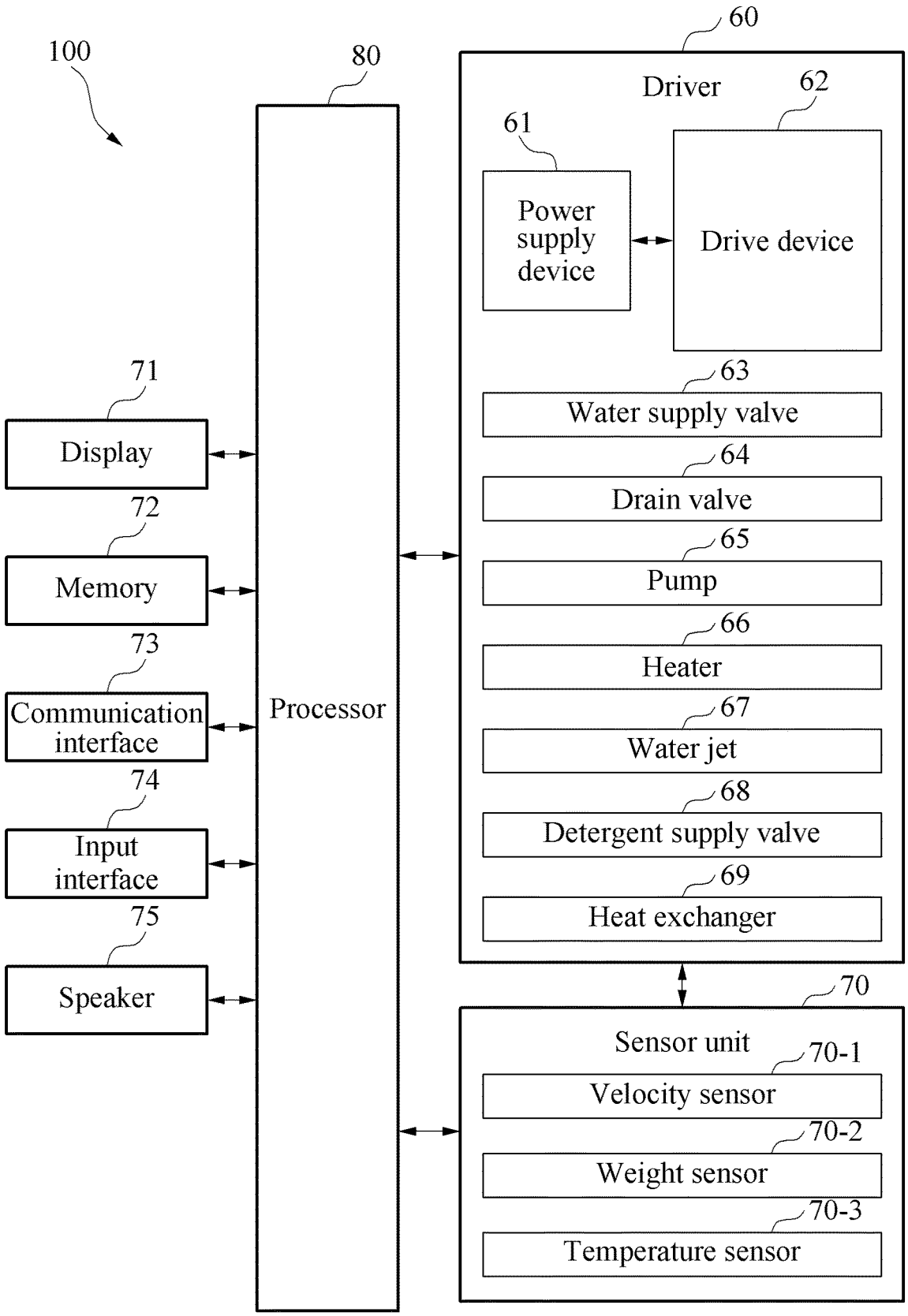
FIG. 3 is a block diagram illustrating a configuration of a clothing processing device according to one embodiment of the present disclosure.

FIG. 3 is a block diagram illustrating a configuration of the clothing processing device 100 according to one embodiment of the present disclosure.

Referring to FIG. 3, the clothing processing device 100 may include at least a portion of the driver 60, a sensor unit 70, and the processor 80.

In one embodiment, the driver 60 may be a component for performing overall and mechanical operation of the clothing processing device 100 and may perform an operation according to the control of the processor 80. The driver 60 may include a power supply device 61 and the drive device 62 and may rotate a drum (e.g., the drum 20 of FIG. 2) of the clothing processing device 100.

In one embodiment, the power supply device 61 may supply power to the drive device 62 and may control rotation velocity and/or torque of the drive device 62. The power supply device 61 may control the driving of the drive device 62 according to a control signal of the processor 80 and for example, the power supply device 61 may control the velocity of a motor of the drive device 62 using a voltage control method or a frequency conversion method.

In one embodiment, the power supply device 61 may be controlled by an intelligent power module (IPM) configured as a switching device. The IPM may be a power module added with a protection function to protect a power device or a driving circuit. For example, for the power supply device 61 configured to control a motor, components of the power supply device 61 and the clothing processing device 100 may be prevented from being damaged by overheating due to an increase in a loading amount.

In one embodiment, the drive device 62 may rotate the drum 20. The drive device 62 may refer to a motor configured to convert energy (e.g., electric power) applied from the outside into power energy.

In one embodiment, the driver 60 may include at least a portion of the water supply valve 63, the drain valve 64, the pump 65, a water jet 67, and the detergent supply valve 68.

In one embodiment, the water supply valve 63 may be open or be closed to supply or block washing water into the drum 20 under the control of the processor 80. The water supply valve 63 may be implemented as a solenoid valve or an electromagnet valve that may be open or be closed by the movement of a coil according to an applied current.

In one embodiment, the water supply valve 63 may be installed between an external water supply pipe (e.g., the water supply pipe 3 of FIG. 2) and a water supply pipe (e.g., the water supply pipe 30 of FIG. 2) of the clothing processing device 100. The water supply pipe 30 of the clothing processing device 100 may connect the external water supply pipe 3 to the drum 20 and when the water supply valve 63 is in an on-state, washing water may be supplied into the drum 20 along the water supply pipe 30. In other words, the water supply valve 63 may control the washing water to be supplied or blocked into the drum 20 from the external water supply pipe 3 based on a state (on or off) of the water supply valve 63.

For example, the water supply pipe 30 may include a first water supply pipe 31 that connects between the external water supply pipe 3 and the detergent accommodation portion 14 and a second water supply pipe (e.g., the second water supply pipe 32 of FIG. 2) that connects between a detergent accommodation portion (e.g., the detergent accommodation portion 14 of FIG. 2) and the drum 20. The washing water supplied from the external water supply pipe 3 may supply, to the drum 20, the detergent contained in the detergent accommodation portion 14 together with the washing water by passing through the detergent supply valve 68 and the detergent accommodation portion 14.

In one embodiment, the drain valve 64 may be open or closed to drain or maintain the washing water contained in the drum 20 under the control of the processor 80. The drain valve 64 may be implemented as a solenoid valve or an electromagnet valve that may be open or be closed by the movement of a coil according to an applied current.

In one embodiment, the drain valve 64 may be installed between a drain pipe (e.g., the drain pipe 40 of FIG. 2) of the clothing processing device 100 and an external drain pipe (e.g., the external drain pipe 4 of FIG. 2). In this case, the drain pipe 40 of the clothing processing device 100 may connect the drum 20 to the external drain pipe 4 and when the drain valve 64 is in an on-state, washing water contained in the drum 20 may be drained to the external drain pipe 4 along the drain pipe 40. In other words, the drain valve 64 may control the washing water to be maintained in the drum 20 or to be drained to the external drain pipe 4 depending on the state (on or off) of the drain valve 64.

In one embodiment, the pump 65 may discharge the washing water contained in the drum 20 to the external drain pipe 4 using power or pressure under the control of the processor 80. For this, the pump 65 may be installed between the drain pipe 40 and the external drain pipe 4.

In one embodiment, the pump 65 may include a shaft (not shown) equipped with an impeller (not shown), an electric motor (not shown) mechanically connected to the shaft, a suction pipe (not shown) connected to the drain pipe 40, and a discharge pipe connected to the external drain pipe 4, and when the drain valve 64 is in an on-state and the impeller rotates by the electric motor of the pump 65, the washing water in the drum 20 may pass through the suction pipe and the discharge pipe and may be forcibly discharged to the external drain pipe 4. In addition, the processor 80 may circulate the washing water of the drum 20 by driving the pump 65 while the drain valve 64 is in an off-state.

In one embodiment, the heater 66 may boil laundry by heating washing water contained in the drum 20 or may clean the drum 20. In one embodiment, when power is applied under the control of the processor 80, the heater 66 may heat the washing water in the drum 20 by converting applied electrical energy into thermal energy.

In one embodiment, the water jet 67 may include a water jet pump (not shown) and a nozzle (not shown), may spray inflowing washing water at high pressure through the nozzle using the water jet pump (not shown), and may remove a contaminant remaining inside the drum 20 by spraying the washing water to a specific position in the drum 20. In this case, the water jet 67 may be implemented as a separate device from the spray nozzle 17 for supplying the washing water to the drum 20 or the water jet 67 may be implemented as one device integrated with the spray nozzle 17.

In one embodiment, the detergent supply valve 68 may open or close the detergent accommodation portion 14 and may automatically control the detergent supplied to the drum 20. The clothing processing device 100 may be implemented to include a detergent supply device (not shown) by including the detergent supply valve 68, the detergent accommodation portion 14, or a detergent sensor (not shown). The detergent supply device (not shown) may accommodate and store a predetermined amount of detergent therein and may automatically supply a predetermined amount of detergent to the drum 20 by calculating a required amount of detergent by the processor 80 and opening the detergent supply valve 68 when the clothing processing device 100 drives. Therefore, the user may conveniently supply an appropriate amount of detergent by the supply device (not shown) without measuring and inputting detergent each time the clothing processing device 100 drives.

In one embodiment, the heat exchanger 69 may dry or heat air passing through the heat exchanger 69 as a refrigerant condenses or expands, and may provide hot and dry gas to the drum 20.

In one embodiment, the sensor unit 70 may sense a surrounding environment or an operation state of the clothing processing device 100 and may generate an electrical signal for a sensing result and may output the electrical signal. The sensor unit 70 may transmit the electrical signal to the processor 80 or may store the sensing result in a memory 72 of the clothing processing device 100 or an external device.

For example, the sensor unit 70 may generate an electrical signal or obtain data by sensing a surrounding environment or an operation state of the clothing processing device 100 while a wash course is performed and may obtain diagnostic information as the processor 80 processes a signal or data received from the sensor unit 70.

In one embodiment, sensors included in the sensor unit 70 may be implemented as separate devices physically separated from each other or may be implemented as one device. In other words, the sensor unit 70 is not limited to a case in which the sensor unit 70 is implemented as one physical device. The sensor unit 70 may transmit a sensing value to the processor 80 and the processor 80 may control an operation of the clothing processing device 100 based on the transmitted sensing value or may store the transmitted sensing value as the diagnostic information in the memory 72 or an external device (e.g., a server or a smartphone) by transmitting the sensing value to the external device through a communication interface 73.

In various embodiments, the sensor unit 70 may include at least a portion of a velocity sensor 70-1, a weight sensor 70-2, and a temperature sensor 70-3.

In one embodiment, the velocity sensor 70-1 may sense the rotation velocity, a rotation angle, and a rotation direction of a motor or the drum 20. The processor 80 may calculate the rotation velocity, the rotation angle, and the rotation direction of the motor or the drum 20 sensed by the velocity sensor 70-1 and may control the operation of the clothing processing device 100 based thereon.

In one embodiment, when the drive device 62 rotates the drum 20, the velocity sensor 70-1 may be implemented as a sensor using a method of sensing a magnitude of load applied to the motor of the drive device 62, a method of sensing an on or off signal of a hall sensor adjacent to a position of a rotor while the motor rotates, or a method of measuring the intensity of a current applied to the driver 60 or the motor during the rotation of the drum 20.

In one embodiment, the weight sensor 70-2 may sense a weight of the drum 20. In addition, the weight sensor 70-2 may sense weights of laundry and the drum 20 when the laundry exists in the drum 20 and may sense the weight of laundry accommodated in the drum 20 by estimating the weight of the laundry by a difference between the sensed weight and a stored weight of the drum 20.

In one embodiment, the weight sensor 70-2 may rotate the drum 20 in which laundry does not exist, may sense the weight of the drum 20, and may obtain the weight of the drum 20 as the diagnostic information. For this, the weight sensor 70-2 may sense the weight of the drum 20 by using a method of estimating an inertial moment from the rotation velocity and the rotation angle of the motor or the drum 20 sensed by the velocity sensor 70-1 described above and estimating a weight corresponding to the inertial moment.

The weight sensor 70-2 in various embodiments may be implemented as various sensors, such as a sensor that estimates the weight of the drum 20 corresponding to a voltage magnitude by sensing the voltage magnitude based on a changed shape of a load cell, wherein the shape of the load cell changes as the weight of the drum 20 is applied to the load cell.

In one embodiment, the temperature sensor 70-3 may be an external temperature sensor for sensing a temperature of a surrounding environment of the clothing processing device 100 or an internal temperature sensor for sensing a temperature of the inside the clothing processing device 100, such as a temperature of washing water in the tub 15, a temperature of the heater 66, and a temperature of the power supply device 61.

In one embodiment, the temperature sensor 70-3 may be implemented as a thermistor, which is a type of a resistor using a property that the resistance of a substance changes depending on the temperature, and in this case, the thermistor may have a negative temperature coefficient (NTC) characteristic in which the resistance decreases as the temperature increases and the resistance increases as the temperature decreases.

In one embodiment, the temperature sensor 70-3 may be a temperature sensor for sensing the temperature of the heater 66 or the washing water. The temperature sensor 70-3 may further include a temperature control unit (e.g., a thermostat) and the temperature control unit may control the washing water or the temperature of the drum 20 to maintain a specific temperature by the heat generated by the heater 66 by detecting an amount of heat generated by the heat exchanger 69.

The sensor unit 70 in one embodiment is not limited to the configuration described above and may further include at least one of a water level sensor configured to sense a water level or a flow rate of washing water, a detergent sensor configured to sense a type or a remaining amount of detergent, a water leakage sensor configured to sense a leakage of washing water, a humidity sensor configured to sense the humidity in air, a turbidity sensor configured to detect the turbidity of washing water, a door sensor configured to sense opening and closing of the door 120, a vibration sensor configured to sense a degree of vibration of the clothing processing device 100, and a valve sensor configured to sense the operation of the water supply valve 63 or the drain valve 64.

In one embodiment, the sensor unit 70 may sense the weight of the drum 20, an abnormality of the water supply valve 63 for supplying washing water, the temperature of washing water, a flow rate of washing water supplied to the drum 20, an abnormality of the motor, an abnormality of the drain valve 64 for draining washing water, a flow rate of washing water drained from the drum 20, or the vibration of the clothing processing device 100. Therefore, the sensor unit 70 may help the improvement of washing performance and a wash operation of the clothing processing device 100 and may sense an abnormal operation of the clothing processing device 100.

In one embodiment, the display 71 may display diagnostic information obtained by the sensor unit 70 under the control of the processor 80 on a display area (e.g., the display area 12 of FIG. 1). The display 71 may be disposed on the front surface of the housing of the clothing processing device 100 and the user may identify an operation state of the clothing processing device 100. Alternatively, the display 71 may not be built into the clothing processing device 100 and may be externally implemented and may display image data on an external display wired or wirelessly connected to the clothing processing device 100.

In one embodiment, the processor 80 may control the overall operation of the clothing processing device 100. For this, the processor 80 may include at least a portion of random access memory (RAM), read-only memory (ROM), a graphics processing unit (GPU), a main central processing unit (CPU), first to n-th interfaces or buses.

In one embodiment, when a user command is received, the processor 80 may perform wash operations in phase by operating the driver 60 based on an input signal. While the clothing processing device 100 is operated, an operation state of the clothing processing device 100 may be sensed by the sensor unit 70 and based thereon, the processor 80 may provide feedback on the operation of the clothing processing device 100 or may obtain and display diagnostic information on the display 71.

In one embodiment, the memory 72 may store various instructions, programs or data required for operating the clothing processing device 100 or the processor 80. The memory 72 may store information obtained by the sensor unit 70 or data received from an external electronic device.

In one embodiment, the memory 72 may be accessed by the processor 80 and may perform data reading, recording, modifying, deleting, and updating by the processor 80. Therefore, in the description of the present disclosure, the term "memory" may include the memory 72, RAM or ROM in the processor 80, or a memory card mounted on the clothing processing device 100.

In one embodiment, the memory 72 may be implemented in volatile memory, such as static RAM (S-RAM) and dynamic RAM (D-RAM), non-volatile memory, such as flash memory, ROM, erasable programmable ROM (EPROM), and electrically EPROM (EEPROM), a hard disk drive (HDD), or a solid state drive (SDD).

In one embodiment, the processor 80 and the memory 72 may be implemented as physically separated components or a single component, for example, in which the processor 80 includes the memory 72. In addition, the processor 80 may be implemented as a single component or one system including a plurality of components. The memory 72 may also be implemented as a single component or one system including a plurality of components.

In one embodiment, the communication interface 73 may transmit and receive various types of data by communicating with an external device (e.g., a server or a smartphone) based on various types of communication schemes. For example, the communication interface 73 may transmit information obtained by the sensor unit 70 to a server (or a smartphone) or may receive a control command to operate the clothing processing device 100 from the server (or the smartphone).

In one embodiment, the communication interface 73 may include at least one of a Bluetooth chip configured to perform wireless communication, a wireless fidelity (Wi-Fi) chip, a wireless communication chip, a near field communication (NFC) chip, an ethernet module configured to perform wired communication, and a universal serial bus (USB) module. In this case, the ethernet module configured to perform wired communication or a USB module may communicate with an external device via an input/output port.

In one embodiment, the input interface 74 may be a component configured to receive various types of user commands from a user and may transmit a received user command to the processor 80. For this, the input interface 74 may include an input device, such as a touch panel, a key, a plurality of manipulation buttons, and a rotating lever (e.g., the input device 13 of FIG. 1).

In one embodiment, a speaker 75 may be built into the clothing processing device 100 and may directly output various pieces of audio data on which various processing tasks, such as decoding, amplification, and noise filtering, are performed by an audio processor (not shown) as well as various notification sounds or voice messages as sound.

Hereinafter, a wash course of the clothing processing device 100 in association with the structure of the clothing processing device 100 and the operation of the processor 80 is briefly described.

In one embodiment, when a user command for managing the clothing processing device 100 is received, the processor 80 may supply washing water to the drum 20 as a water supply operation. Specifically, the processor 80 may control the water supply valve 63 to be opened by changing the water supply valve 63 in an off-state to be in an on-state and thereby, may supply the washing water to the drum 20.

In this case, the processor 80 may adjust an amount of washing water supplied to the drum 20 by adjusting the time in which the water supply valve 63 maintains the on-state. In this case, the amount of washing water supplied in the wash course may be determined based on a capacity of the drum 20. For example, the amount of washing water supplied in the wash course may be determined to be a maximum amount that the drum 20 is able to accommodate or an amount at a preset ratio. In addition, the processor 80 may adjust the temperature of washing water supplied to the drum 20 by adjusting the time in which the water supply valve 63 maintains the on-state for cold and hot water. The processor 80 may also adjust the temperature of washing water by operating the heater 66.

In one embodiment, when a preset amount of washing water is supplied to the drum 20, the processor 80 may control the water supply valve 63 to be closed by changing the on-state of the water supply valve 63 to the off-state and thereby, may stop supplying the washing water. When the supply of the washing water is stopped and the water supply operation is completed, the processor 80 may control the driver 60 to rotate the drum 20 containing the washing water as a wash operation.

In one embodiment, the processor 80 may apply control signal to the power supply device 61, and the control signal for the motor of the drive device 62 to rotate the drum 20 containing the washing water and the power supply device 61 may rotate the motor based on the applied control signal, may transmit a rotational force to the drum 20, and may rotate the drum 20. In addition, the processor 80 may control the water jet 67 to spray hot and high-pressure washing water to remove a contaminant attached to the laundry and the drum 20. When the wash operation is completed, the processor 80 may drain the washing water contained in the drum 20 as a drain operation. Specifically, the processor 80 may control the drain valve 64 to be open by changing the off-state of the drain valve 64 to the on-state and thereby, may drain the washing water contained in the drum 20 to the outside. Additionally, the processor 80 may control the pump 65 to discharge the washing water contained in the drum 20 to the external drain pipe 4 using power or pressure.

In one embodiment, the processor 80 may control the driver 60 to rotate the drum 20 as a spin-dry operation. The power supply device 61 may rotate the drum 20 by transmitting a rotational force to the drum 20 by driving the drive device 62 in response to the applied control signal. For example, the control signal may be a signal for driving the drive device 62 in phase by applying a current to a motor and a clutch of the drive device 62 or may be a signal for driving the drive device 62 at the rotation velocity that decelerates, accelerates, or maintains over time.

In the embodiment described above, the drain operation and the spin-dry operation are separately performed. However, this may be a part of various operations and the drain operation and the spin-dry operation may be simultaneously performed or the drain operation may be performed after the spin-dry operation.

Figure 4:
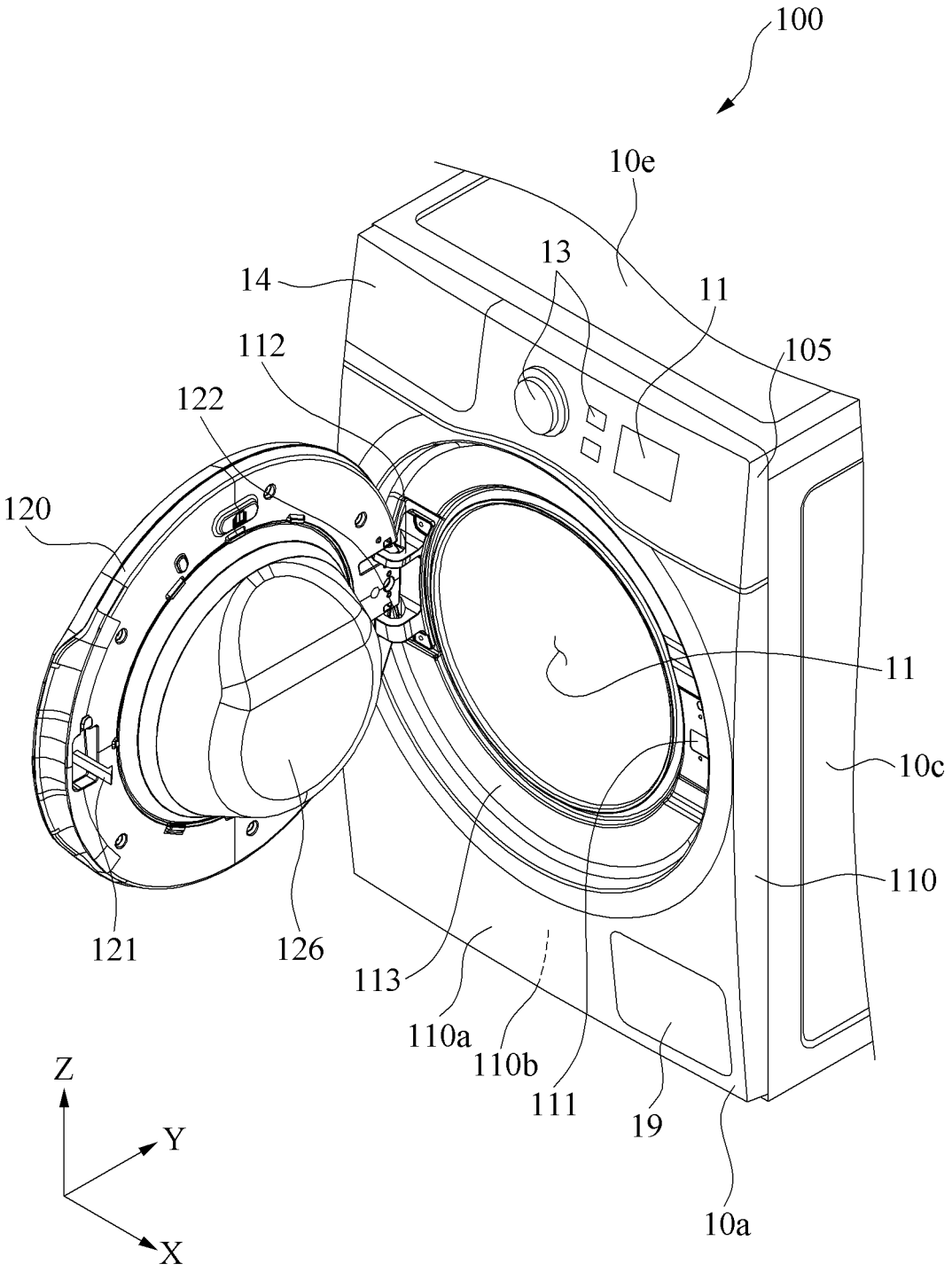
FIG. 4 is a perspective view of a partial area of a clothing processing device according to one embodiment of the present disclosure.

FIG. 4 is a perspective view of a partial area of a clothing processing device according to one embodiment of the present disclosure. Specifically, FIG. 4 is a diagram illustrating the front surface 10*a* in which the door 120 of the clothing processing device 100 of FIG. 1 is open.

Referring to FIG. 4, the door 120 of the clothing processing device 100 in various embodiments may be rotatably coupled to the front surface of the front panel 110.

In one embodiment, the front panel 110 may include a first surface 110*a* forming the front surface 10*a* of the clothing processing device 100 and a second surface 110*b* that is opposite to the first surface 110*a*. In one embodiment, the second surface 110*b* of the front panel 110 may be a surface facing the tub 15 and/or the drum 20 and the second surface 110*b* of the front panel 110 may be an inner surface of the front panel 110 that is not exposed to a user.

In one embodiment, the front panel 110 may include the opening 11 opening from the first surface 110*a* to the second surface 110*b*. The opening 11 may be open in a direction of an inlet area (e.g., the inlet area 21 of FIG. 2) of the drum 20. The opening 11 may be a clothing input slot of the clothing processing device 100 and the opening 11 of the front panel 110 may be open or closed by the rotation of the door 120.

In one embodiment, the front panel 110 may include a first locking member 111 configured to selectively fix the door 120 and a first hinge member 112 rotatably connected to the door 120. The first locking member 111 and the first hinge member 112 may be provided on the first surface 110*a* of the front panel 110.

In one embodiment, the front panel 110 may include a seating groove 113 in which the door 120 is seated while the door 120 closes the opening 11. The seating groove 113 may protrude in an inner direction (e.g., the +Y direction) of the cabinet 10 along the circumference of the opening 11. The seating groove 113 may have an inwardly concave shape to the inside of the cabinet 10 based on the first surface 110*a*. In various embodiments, when the door 120 is closed and the door 120 is seated on the seating groove 113, the front surface 10*a* of the clothing processing device 100 may form a substantially flat plane. However, the example is not limited thereto and may be variously implemented.

In one embodiment, the control panel 105 may be disposed in one direction (e.g., the +Z direction) of the front panel 110. The user may identify an operation state of the clothing processing device 100 using the display area 12 and/or the input device 13 of the control panel 105 or may control the operation of the clothing processing device 100.

In one embodiment, the door 120 may be rotatably connected to the first surface 110*a* of the front panel 110 and may open or close the opening 11. In one embodiment, the door 120 may have a shape corresponding to the shape of the opening 11 and for example, may be formed in an approximately annular or polygonal shape.

In one embodiment, the door 120 may include a second locking member 121 coupled to the first locking member 111 and selectively restricting the movement of the door 120. For example, the second locking member 121 may be implemented in a movable latch shape and the first locking member 111 may be fastened to or separated from the second locking member 121 based on the movement of the second locking member 121.

In one embodiment, the door 120 may include a second hinge member 122 connected to the first hinge member 112 and the door 120 may rotate at a predetermined angle based on the second hinge member 122 as an axis. However, the example is not limited thereto in the actual implementation and the door 120 may be slidably connected to the front panel 110. In one embodiment, the door 120 may include a door glass 126 protruding toward the inside the cabinet 10.

In one embodiment, while the door 120 closes the opening 11, the door glass 126 may be formed of a substantially transparent material for a user to check the inside of the drum 20. Based on a state in which the door 120 closes the opening 11, the door glass 126 may have an inwardly convex shape toward the inside the cabinet 10. When the door 120 closes the opening 11, at least a portion of the door glass 126 may be inserted into the cabinet 10.

Hereinafter, to describe the front panel 110, the door 120, an insulator 140, and a heat dissipating sheet 150 of the clothing processing device 100 with reference to FIGS. 5A to 8B, any repeated description related to the descriptions of FIGS. 1 to 4 is omitted for ease of description.

Figure 5A:
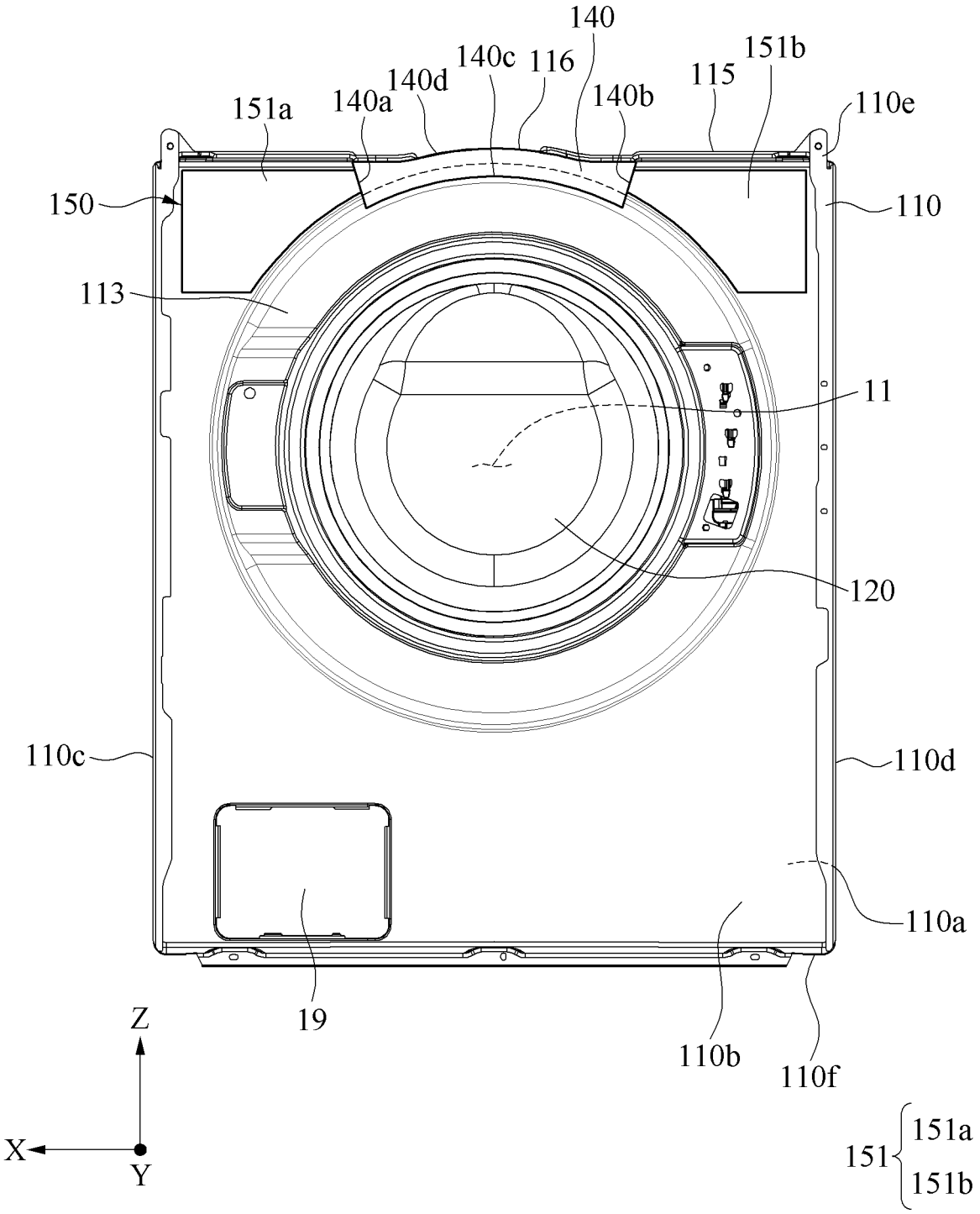
FIG. 5A is a rear view of a front panel and a door according to one embodiment of the present disclosure.
Figure 5B:
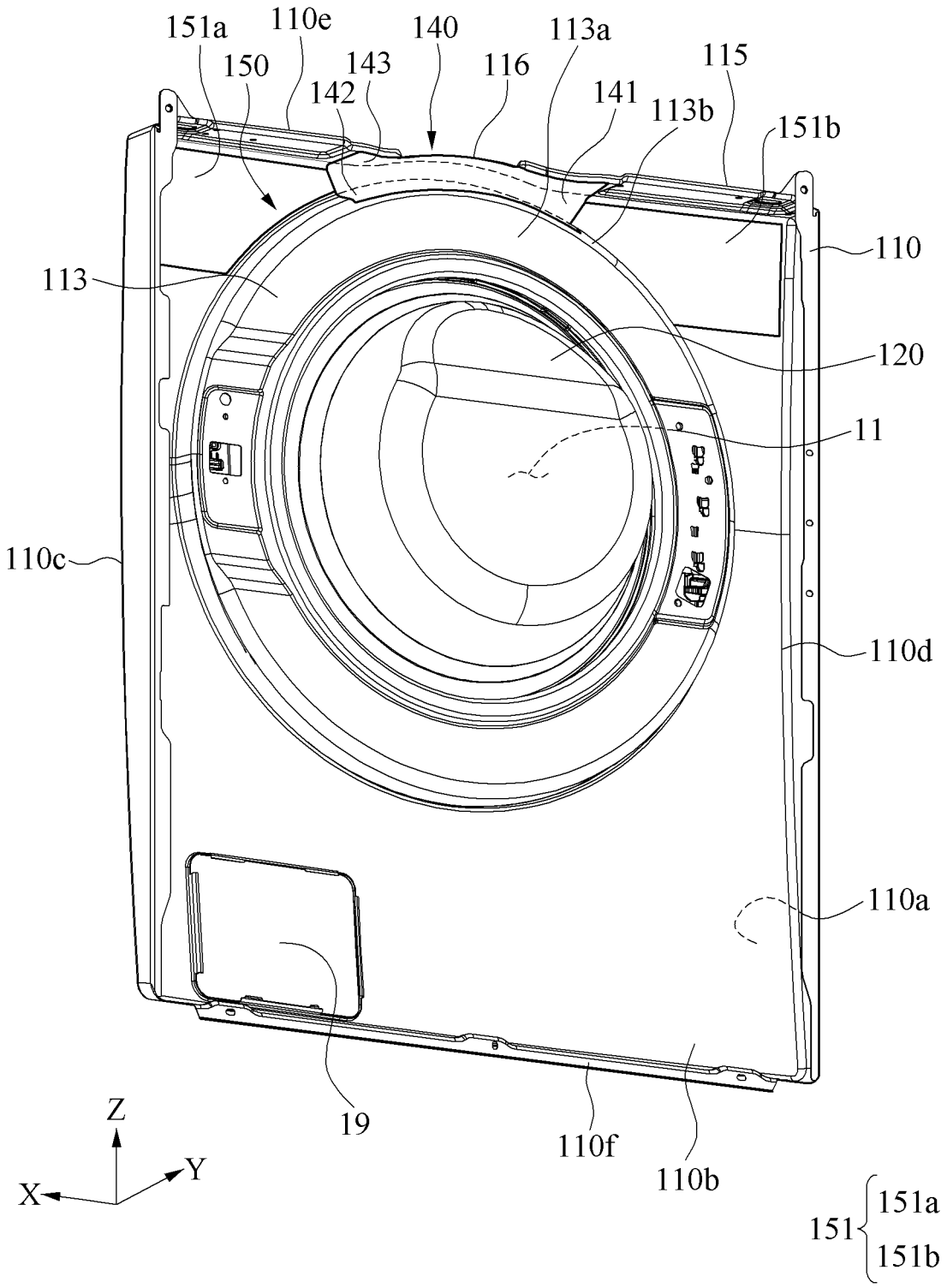
FIG. 5B is a perspective view of a front panel and a door according to one embodiment of the present disclosure.

FIG. 5A is a rear view of the front panel 110 and the door 120 according to one embodiment of the present disclosure and FIG. 5B is a perspective view of the front panel 110 and the door 120 according to one embodiment of the present disclosure.

Referring to FIGS. 5A and 5B, the clothing processing device 100 in various embodiments may include at least a portion of the insulator 140 and the heat dissipating sheet 150 to prevent a partial area of the front panel 110 from overheating.

In one embodiment, based on a state viewing the second surface 110*b* of the front panel 110, the front panel 110 may include at least a portion of an upper end 110*e*, a lower end 110*f*, a left end 110*c*, and a right end 110*d*.

For example, the upper end 110*e* may be an end or a boundary surface in the upper direction (e.g., the +Z direction) of the front panel 110 and the lower end 110*f* may be an end or a boundary surface in the lower direction (e.g., the −Z direction) that is opposite to the upper end 110*e*. For example, when viewing the second surface 110*b*, the left end 110*c* may be an end or a boundary surface in one direction (e.g., the +X direction) based on both directions (e.g., the + and −X directions) that is perpendicular to the vertical direction and substantially in parallel with the ground surface, and when viewing the second surface 110*b*, the right end 110*d* may be an end or a boundary surface in the other direction (e.g., the −X direction) that is opposite to the left end 110*c*.

In various embodiments, the upper end 110*e*, the lower end 110*f*, the left end 110*c*, and the right end 110*d* of the front panel 110 may be side surfaces defined by limiting a direction based on the second surface 110*b*, and this may be a virtual structure for ease of description. In the actual implementation, boundaries thereof may be mutually vague or partial areas may overlap depending on the structure of the front panel 110.

In one embodiment, the front panel 110 may include an extended surface 115 extending in an inner direction (e.g., the +Y direction) of the cabinet 10 from the upper end 110*e*. In various embodiments, the extended surface 115 may be formed on at least a portion of the lower end 110*f*, the left end 110*c*, and the right end 110*d* of the front panel 110. In various embodiments, the extended surface 115 may be an area for connecting the front panel 110 to the cabinet 10.

In one embodiment, the extended surface 115 may include a nose 116 that is curved and forms a gap with the seating groove 113. Similar to the extended surface 115, the seating groove 113 may protrude toward the inside the cabinet 10 based on the second surface 110*b* and a predetermined space may be formed between the seating groove 113 and the extended surface 115. The nose 116 may be an area curved in a direction (e.g., the +Z direction) in which the extended surface 115 moves away from the seating groove 113 to maintain the width between the seating groove 113 and the extended surface 115 to be more than or equal to a predetermined value.

In one embodiment, the seating groove 113 may include a flat portion 113*a* and an inclined portion 113*b*. For example, the flat portion 113*a* may be a substantially flat portion while viewing the second surface 110*b*. The inclined portion 113*b* may be an inclined area extending from the second surface 110*b* to connect the second surface 110*b* to the flat portion 113*a* and the seating groove 113 may protrude from the second surface 110*b* through the inclined portion 113*b*. In various embodiments, a partial area of the inclined portion 113*b* disposed in the direction of the upper end 110*e* of the front panel 110 may be disposed to face at least a partial area of the nose 116.

In one embodiment, a partial area of the upper end 110*e* of the front panel 110, for example, a partial area between the nose 116 and the inclined portion 113*b* of the seating groove 113 may be overheated.

For example, when the clothing processing device 100 proceeds with a dry operation, hot air may be transferred to the inside the drum 20 and the air of the drum 20 may be transferred to the front panel 110 through an inlet area (e.g., the inlet area 21 of FIG. 2) of the drum 20. Since hot air tends to ascend compared to cold air, a partial area adjacent to the upper end 110*e* of the front panel 110 may be at risk of overheating compared to other areas. The area between the seating groove 113 and the extended surface 115 may be a substantially central upper area of the front panel 110. A groove structure may be formed in a partial area of the upper area of the front panel 110 by the structure of the extended surface 115 and the seating groove 113, air circulation with other areas may be restricted, and since heat and/or air stays the groove structure, consequently, the corresponding area may be overheated compared to other areas.

For example, when the door 120 has a substantially annular structure and the extended surface 115 is a flat structure, the seating groove 113 having a shape corresponding to the shape of the door 120 may be adjacent to the extended surface 115 in a partial area (e.g., an area in the upper direction from the center of the door 120) and the adjacent partial area may be at risk of overheating. In various embodiments, the nose 116 may be curved to maintain a predetermined width between the seating groove 113 and the extended surface 115 and the nose 116 may form a space in which heat or air spreads to prevent a corresponding area from overheating by forming a predetermined gap.

In various embodiments, as heat emitted from the drum 20 stays in an area in which the nose 116 and the seating groove 113 face each other in the front panel 110, the corresponding area may be overheated. When a user touches or contacts the front panel 110, the user may be burned due to an overheated state of the front panel 110. Alternatively, since the control panel 105 is disposed on the upper portion of the front panel 110, an internal component may be damaged as the heat is transferred to the control panel 105. To prevent this, the front panel 110 may include the insulator 140 and the heat dissipating sheet 150.

In one embodiment, the insulator 140 and the heat dissipating sheet 150 may prevent a partial area of the front panel 110 from overheating. For example, the insulator 140 and the heat dissipating sheet 150 may diffuse heat to prevent a space between the nose 116 and the seating groove 113 from overheating. The insulator 140 may block heat transfer and the heat dissipating sheet 150 may diffuse heat of a partial area to another area.

In one embodiment, the insulator 140 may be disposed between the nose 116 and the seating groove 113 in the second surface 110*b*. The insulator 140 may prevent a partial area of the front panel 110 between the nose 116 and the seating groove 113 from overheating.

In one embodiment, the insulator 140 may be formed of a material having low thermal conductivity or high heat-resistance, and may include, for example, at least a portion of an expanded Styrofoam material, cork, magnesia, fiberglass, or asbestos. In various embodiments, the insulator 140 may be formed in a multi-layer structure in which a plurality of insulating layers formed of an insulating material is stacked. The multi-layer structure of insulating layers may be designed by considering various factors, such as an operation environment of the clothing processing device 100 and structures of the front panel 110 and other components.

In one embodiment, the insulator 140 may include a plurality of side surfaces 140*a*, 140*b*, 140*c*, and 140*d*. For example, the insulator 140 may include the left side surface 140*a* facing the left end 110*c* of the front panel 110, the right side surface 140*b* facing the right end 110*d* of the front panel 110, the lower side surface 140*c* facing the lower end 110*f* of the front panel 110, and the upper side surface 140*d* facing the upper end 110*e* of the front panel 110. However, the plurality of side surfaces 140*a*, 140*b*, 140*c*, and 140*d* may be side surfaces arbitrarily divided based on the circumference of the insulator 140 and in the actual implementation, the insulator 140 may be formed as a circle or a polygon with a curvature, and boundaries of the plurality of side surfaces 140*a*, 140*b*, 140*c*, and 140*d* may be vague or overlap with each other.

In one embodiment, the insulator 140 may include a plurality of thermal insulating areas 141, 142, and 143. The plurality of thermal insulating areas 141, 142, and 143 may be attached to a section in which heat may stagnate in the front panel 110 and may prevent the corresponding area from overheating. For example, the first thermal insulating area 141 may be an area disposed on the second surface 110*b* substantially in parallel with the second surface 110*b* while viewing the second surface 110*b*. The second thermal insulating areas 142 and 143 may be disposed on at least one of the seating groove 113 and the nose 116 while viewing the second surface 110*b*, and for example, may include the lower thermal insulating area 142 disposed on the seating groove 113 and the upper thermal insulating area 143 disposed on the nose 116.

In one embodiment, the heat dissipating sheet 150 may be attached to the second surface 110*b* of the front panel 110 to surround at least a portion of the circumference of the insulator 140. The heat dissipating sheet 150 may diffuse heat to another area to prevent a partial area of the front panel 110 from overheating.

In various embodiments, the heat dissipating sheet 150 may be disposed adjacent to, apart from, or overlapping with at least a portion of the plurality of side surfaces 140*a*, 140*b*, 140*c*, and 140*d* of the insulator 140. The heat dissipating sheet 150 may prevent a partial area from overheating by diffusing heat between the nose 116 and the seating groove 113 to another area of the front panel 110.

In one embodiment, the heat dissipating sheet 150 may be formed of thermally conductive material having high thermal conductivity, and for example, may be a metal sheet including metal, such as aluminum, copper, and iron. In various embodiments, the insulator 140 may have a structure in which a thermal conductive layer formed of a thermally conductive material and an adhesive layer configured to bond the thermal conductive layer to the front panel 110 are stacked and may be formed in a multi-layer structure in which thermal conductive layers are stacked. The multi-layer structure of the heat dissipating sheet 150 may be variously designed by considering various factors, such as an operation environment of the clothing processing device 100 and structures of the front panel 110 and other components.

In one embodiment, the heat dissipating sheet 150 may be attached to various positions in various shapes in a direction of the second surface 110*b* of the front panel 110 and hereinafter, various embodiments are described based on the position to which the heat dissipating sheet 150 is attached.

In one embodiment, as shown in FIGS. 5A and 5B, when viewing the second surface 110*b*, the heat dissipating sheet 150 may include a first sheet area 151 disposed between the insulator 140 and at least one of the left end 110*c* and the right end 110*d* of the second surface 110*b*.

In one embodiment, the first sheet area 151 may be disposed in a horizontal direction (e.g., the X-axis direction) of the insulator 140 and may transfer heat of an area in which the insulator 140 is disposed in the front panel 110 to be diffused in the horizontal direction. For example, the first sheet area 151 may be disposed adjacent to at least a portion of the left and right side surfaces 140 and 140*b* of the insulator 140.

In one embodiment, when viewing the second surface 110*b*, the first sheet area 151 may include a first left sheet area 151*a* disposed between the left side surface 140*a* of the insulator 140 and the left end 110*c* of the second surface 110*b*, and/or when viewing the second surface 110*b*, the first sheet area 151 may include a first right sheet area 151*b* disposed between the right side surface 140*b* of the insulator 140 and the right end 110*d* of the second surface 110*b*.

In one embodiment, the first sheet area 151 may be disposed along at least a partial area of the circumstance of the seating groove 113 in the second surface 110*b*. For example, the first sheet area 151 may be disposed to prevent overlapping with the inclined portion 113*b* of the seating groove 113 and may be disposed on a partial area that is substantially flat.

In various embodiments, the first sheet area 151 may exclude an inclinedly curved area along the seating groove 113 and may be attached to a substantially flat surface. The heat dissipating sheet 150 may be easily attached to a flat surface and the manufacturing difficulty of the insulator 140 and the heat dissipating sheet 150 may be reduced. For example, the heat dissipating sheet 150 may be lifted or torn in a curved area and the attachment difficulty of the heat dissipating sheet 150 may increase. Alternatively, since the heat dissipating sheet 150 needs to be cut in advance to fit the shape of the heat dissipating sheet 150 by considering a curved portion, the manufacturing process and the manufacturing difficulty may increase. Since the first sheet area 151 is attached to a substantially flat surface in the second surface 110*b*, the manufacturing efficiency may be improved.

In one embodiment, when viewing the second surface 110*b*, the first sheet area 151 may be substantially in contact with at least one of the left end 110*c* and the right end 110*d* of the insulator 140. In various embodiments, the first sheet area 151 may directly receive heat from the insulator 140 and may diffuse the heat in the horizontal direction (e.g., the + and −X directions). However, the example is not limited thereto and the heat dissipating sheet 150 may be spaced apart from the insulator 140 by a predetermined gap.

In one embodiment, when viewing the second surface 110*b*, in the first sheet area 151, an end that is opposite to an end contacting the insulator 140 may be substantially in contact with one of the left end 110*c* and the right end 110*d* of the second surface 110*b*.

In various embodiments, the first sheet area 151 may be attached in the horizontal direction of the second surface 110*b* as widely as possible and may diffuse heat to a wide area from the insulator 140 in the horizontal direction. The example is not limited thereto and the first sheet area 151 may be limitedly disposed in a central area of the second surface 110*b* with a predetermined gap or may be attached to the second surface 110*b* in various structures.

FIGS. 6A to 6D are rear views of the front panel 110 and the door 120 according to one embodiment of the present disclosure.

Specifically, for the front panel 110, the door 120, the insulator 140, and the heat dissipating sheet 150 of FIGS. 5A and 5B, FIGS. 6A to 6D are diagrams illustrating the heat dissipating sheet 150 in various implementable embodiments. Hereinafter, any repeated description related to the description provided above is omitted and the structure of the heat dissipating sheet 150 is mainly described.

Figure 6A:
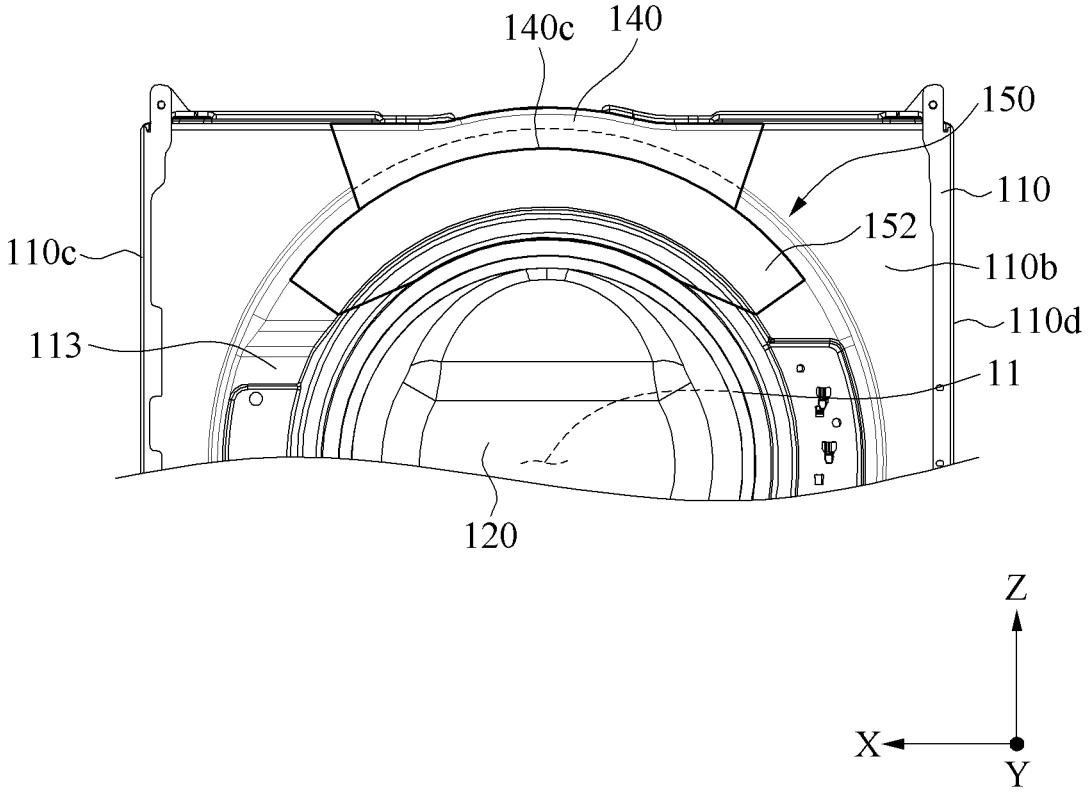
FIG. 6A is a rear view of a front panel and a door according to one embodiment of the present disclosure.

Referring to FIG. 6A, the heat dissipating sheet 150 in various embodiments may include a second sheet area 152.

In one embodiment, when viewing the second surface 110*b*, the second sheet area 152 may be disposed between the insulator 140 and the opening 11 to attach at least a partial area of the second sheet area 152 to the seating groove 113. In consideration of the shape of the insulator 140, the length of the lower side surface 140*c* of the insulator 140 may be greater than respective lengths of left and right side surfaces (e.g., the left and right side surfaces 140*a* and 140*b* of FIG. 5) of the insulator 140. The second sheet area 152 may be disposed to face the lower side surface 140*c* in the circumference of the insulator 140 and an area that is in contact with the insulator 140 may widen, and may be advantageous to receive heat from the insulator 140 and an area adjacent thereto and diffuse the heat.

In one embodiment, the second sheet area 152 may be attached to the seating groove 113 and for example, may extend along the seating groove 113 to enclose at least a portion of the circumference of the opening 11. For example, the second sheet area 152 may be disposed on the flat portion 113*a* of the seating groove 113. The second sheet area 152 may be attached to a substantially flat surface extending from a flat portion (e.g., the flat portion 113*a* of FIG. 5B) and in this case, since the second sheet area 152 may be more easily attached, the manufacturing efficiency may be improved by comparing with a case in which the second sheet area 152 is attached to an inclined portion (e.g., the inclined portion 113*b* of FIG. 5B).

In various embodiments, an area corresponding to the seating groove 113 of the second surface 110*b* may be an area occluded by the door 120 to the inside the clothing processing device 100 while the door 120 closes the opening 11. Since the second sheet area 152 is attached to the seating groove 113, the second sheet area 152 may transfer heat to the inside the door 120 of the clothing processing device 100 that the user's hand may not touch.

Figure 6B:
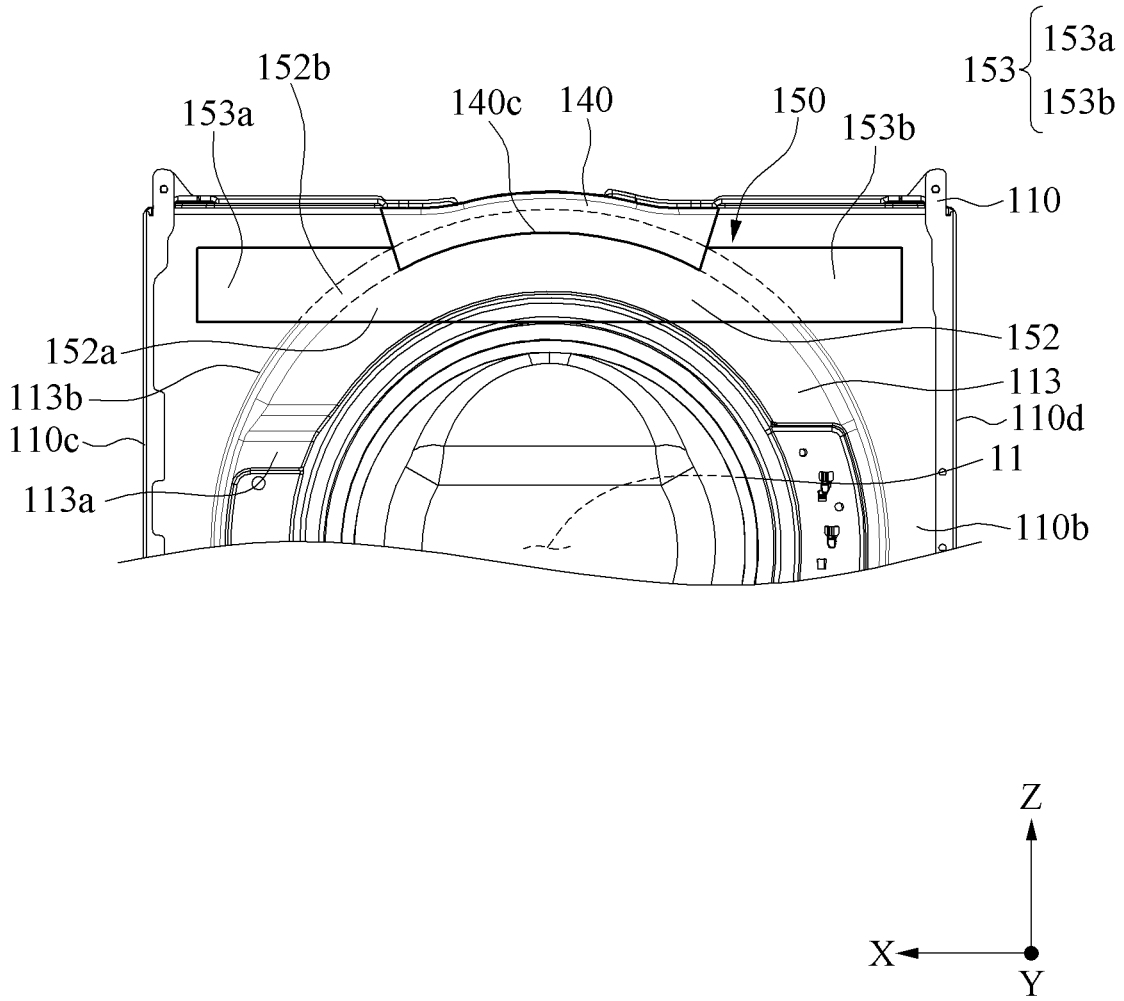
FIG. 6B is a rear view of a front panel and a door according to one embodiment of the present disclosure.

Referring to FIG. 6B, the second sheet area 152 in various embodiments may further include an inclined sheet portion 152*b* and the heat dissipating sheet 150 may include a third sheet area 153.

In one embodiment, the second sheet area 152 may include a flat sheet portion 152*a* attached to the flat portion 113*a* of the seating groove 113 and the inclined sheet portion 152*b* attached to the inclined portion 113*b*. In various embodiments, the inclined sheet portion 152*b* may receive heat from the flat sheet portion 152*a* and may diffuse the heat to a wide area.

In one embodiment, the inclined sheet portion 152*b* and the flat sheet portion 152*a* may be connected to each other and formed as one body, may be segmented or spaced apart from each other, or may be attached to each other to overlap with each other in at least a partial area. In various embodiments, the inclined sheet portion 152*b* and the flat sheet portion 152*a* may extend along the circumference of the seating groove 113. The second sheet area 152 may diffuse heat to the seating groove 113 that is not exposed to the outside of the front panel 110 while the door 120 closes the opening 11 and may stably transfer heat of a partial area of the front panel 110 to another area.

In one embodiment, when viewing the second surface 110*b*, the third sheet area 153 may be disposed between the second sheet area 152 and at least one of the left end 110*c* and the right end 110*d* of the second surface 110*b*. The third sheet area 153 may receive heat from the second sheet area 152 and may diffuse heat in a direction away from the opening 11.

In one embodiment, the third sheet area 153 may include a third left sheet area 153*a* and a third right sheet area 153*b*. When viewing the second surface 110*b*, the third left sheet area 153*a* may be disposed between the second sheet area 152 and the left end 110*c* of the second surface 110*b* and the right sheet area 153*b* may be disposed between the second sheet area 152 and the right end 110*d* of the second surface 110*b* when viewing the second surface 110*b*.

In one embodiment, the third sheet area 153 may receive heat from the second sheet area 152 and may diffuse the heat to another area in the second surface 110*b*. For example, a partial area adjacent to the upper end 110*e* of the second surface 110*b* or a partial area adjacent to the seating groove 113 may be adjacent to an inlet area (e.g., the inlet area 21 of FIG. 2) of the drum 20 or may be overheated by directly receiving heat from the drum 20. The third sheet area 153 may diffuse heat from the areas described above to a relatively far area and may effectively prevent the partial area of the front panel 110 from overheating.

In one embodiment, the third sheet area 153 may be an area, which is separated from the insulator 140 of the heat dissipating sheet 150 and is connected to the second sheet area 152, compared to the first sheet area (e.g., the first sheet area 151 of FIG. 5A). In various embodiments, the third sheet area 153 may be integrally formed as one body with the second sheet area 152.

In one embodiment, the heat dissipating sheet 150 may be attached to the front panel 110 by passing through the flat portion 113*a* of the seating groove 113, the inclined portion 113*b*, and the second surface 110*b* in a manufacturing process. In another embodiment, the third sheet area 153 may be spaced apart from the second sheet area 152 by a predetermined gap.

Figure 6C:
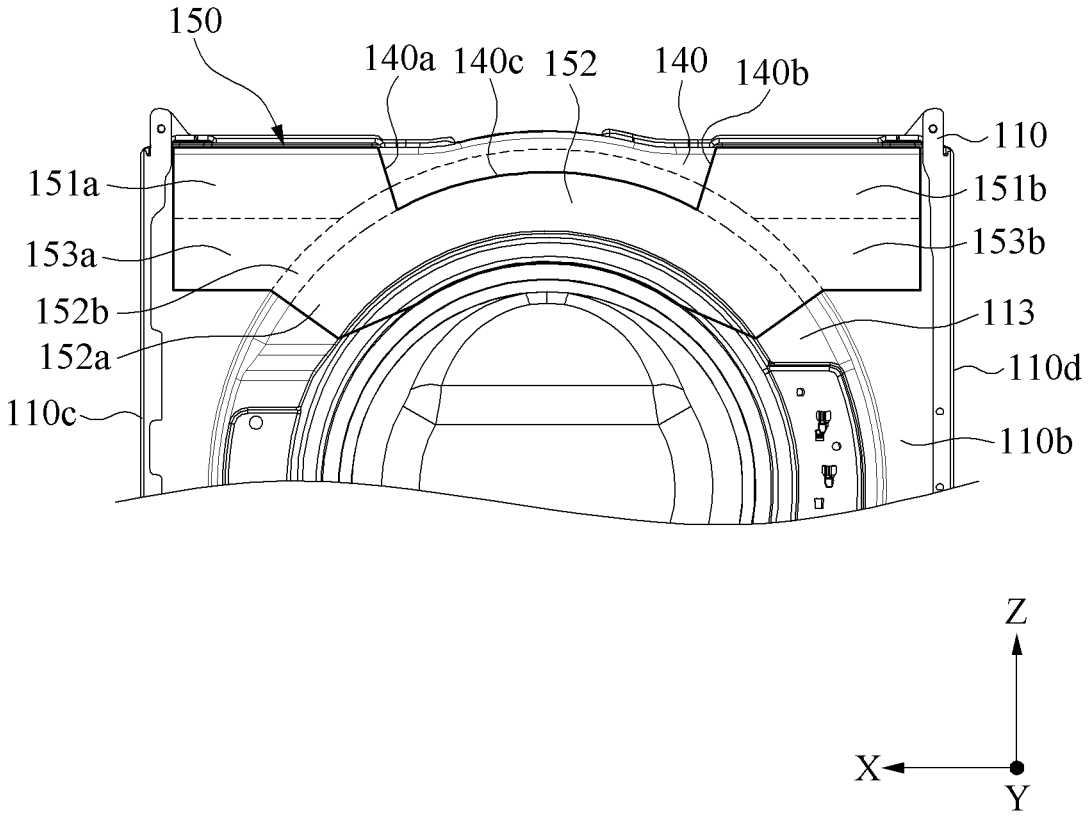
FIG. 6C is a rear view of a front panel and a door according to one embodiment of the present disclosure.

Referring to FIG. 6C, the heat dissipating sheet 150 in various embodiments may include at least a portion of the a first sheet area (e.g., the first sheet area 151 of FIG. 5A), a second sheet area (e.g., the second sheet area 152 of FIG. 6A), and a third sheet area (e.g., the third sheet area 153 of FIG. 6B). In various embodiments, the first sheet area 151 may include the first sheet area 151 may include the first left sheet area 151*a* and the first right sheet area 151*b*, the second sheet area 152 may include the flat sheet portion 152*a* and the inclined sheet portion 152*b*, and the third sheet area 153 may include the third left sheet area 153*a* and the third right sheet area 153*b*.

To illustrate FIG. 6C, areas of the heat dissipating sheet 150 are divided for ease of description. However, in the actual implementation, the heat dissipating sheet 150 may be integrally formed as one body, mutual boundaries may be vague, or partial areas may overlap each other.

In one embodiment, the heat dissipating sheet 150 may include the first sheet area 151 and the second sheet area 152 and the heat dissipating sheet 150 may be disposed to enclose the left and right side surfaces 140*a* and 140*b*, and the lower side surface 140*c* of the insulator 140. The heat dissipating sheet 150 may be disposed to enclose substantially most areas facing the front panel 110 among the circumference of the insulator 140 and may efficiently receive heat from the an area adjacent to the insulator 140.

In one embodiment, the third sheet area 153 may receive heat from the first sheet area 151 and/or the second sheet area 152 and may diffuse the heat to another area in the front panel 110. In various embodiments, the third sheet area 153 may be a partial area in which the first sheet area 151 extends to the lower end 110*f* of the second surface 110*b* or a partial area in which the second surface 110*b* of the second sheet area 152 extends in the direction of the left end 110*c* and/or the right end 110*d*. Alternatively, in various embodiments, the third sheet area 153 may be a partial area that connects the first sheet area 151 and the second sheet area 152 to each other.

Figure 6D:
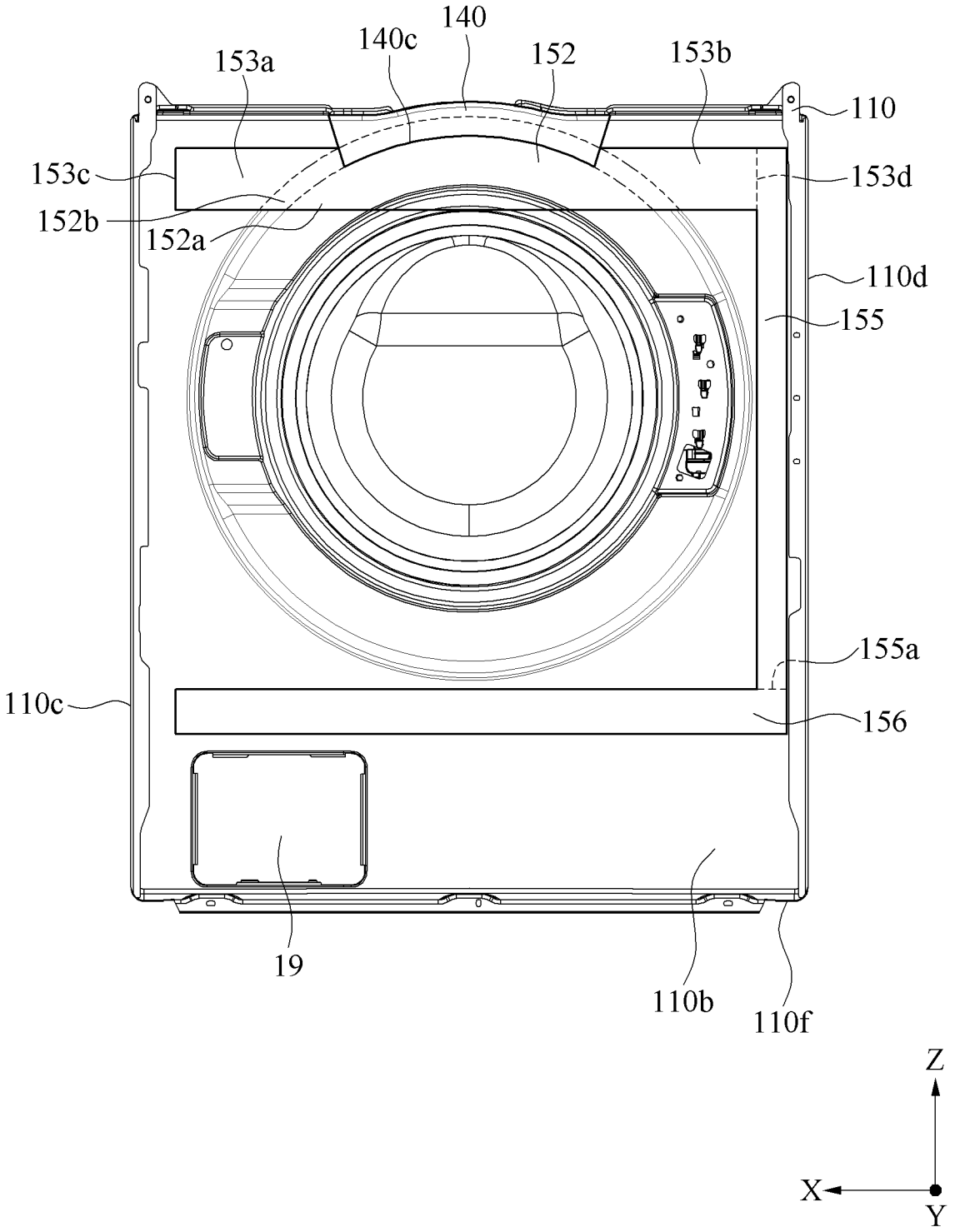
FIG. 6D is a rear view of a front panel and a door according to one embodiment of the present disclosure.

Referring to FIG. 6D, the heat dissipating sheet 150 in various embodiments may include a portion of a first extended area 155 and the second extended area 156.

In one embodiment, when viewing the second surface 110*b*, the first extended area 155 may extend from at least one of a left side surface 153*c* and a right side surface 153*d* of the third sheet area 153 in a lower direction (e.g., the −Z direction) facing the lower end 110*f* of the second surface 110*b*.

In various embodiments, as shown in FIG. 6D, the first extended area 155 may be connected to the third sheet area 153, but is not limited thereto and may be connected to the first sheet area 151 or the second sheet area 152. Alternatively, the first extended area 155 may be spaced part from the other sheet areas 151, 152, and 153 by a predetermined gap or a partial area thereof may overlap the other sheet areas 151, 152, and 153.

For example, the first extended area 155 may be a partial area in which one of the first sheet area 151, the second sheet area 152, and the third sheet area 153 extends in the direction of the lower end 110*f* of the front panel 110 and the first extended area 155 may be integrally formed with the connected one of the sheet areas 151, 152, and 153 as one, may be separated and spaced apart from each other, or at least a partial area thereof may overlap and may be attached.

In one embodiment, the second extended area 156 may be connected to a lower side surface 155*a* of the first extended area 155 and may extend in the horizontal direction (e.g., the + and −X directions). Alternatively, when viewing the second surface 110*b*, the second extended area 156 may extend from the first extended area 155 in a direction in which the opening is surrounded. In various embodiments, the first extended area 155 and the second extended area 156 may have a rectangular shape to enclose the opening 11 as shown in FIG. 6D. However, the example is not limited thereto and the first extended area 155 and the second extended area 156 may have a ring shape or a polygonal shape to enclose at least a partial area of the circumference of the opening 11.

In one embodiment, the first extended area 155 may transfer heat concentrated on the upper end 110*e* of the front panel 110 and the extended surface 115 in the direction of the lower end 110*f* (e.g., the −Z direction) and the second extended area 156 may transfer the heat transferred to the lower end 110*f* in the horizontal direction (e.g., the + and −X directions) through the first extended area 155.

In various embodiments, the first extended area 155 and the second extended area 156 may be attached to a flat surface of the second surface 110*b* to not overlap the seating groove 113 of the second surface 110*b* or at least a portion thereof may be attached to the inclined portion 113*b*.

The structure of the heat dissipating sheet 150 in various embodiments shown in FIGS. 5A to 6D is an example to describe the heat dissipating sheet 150. However, the actual implementation is not limited thereto and the example may be implemented with various modifications within a scope easily derived by one of ordinary skill in the art.

Figure 7:
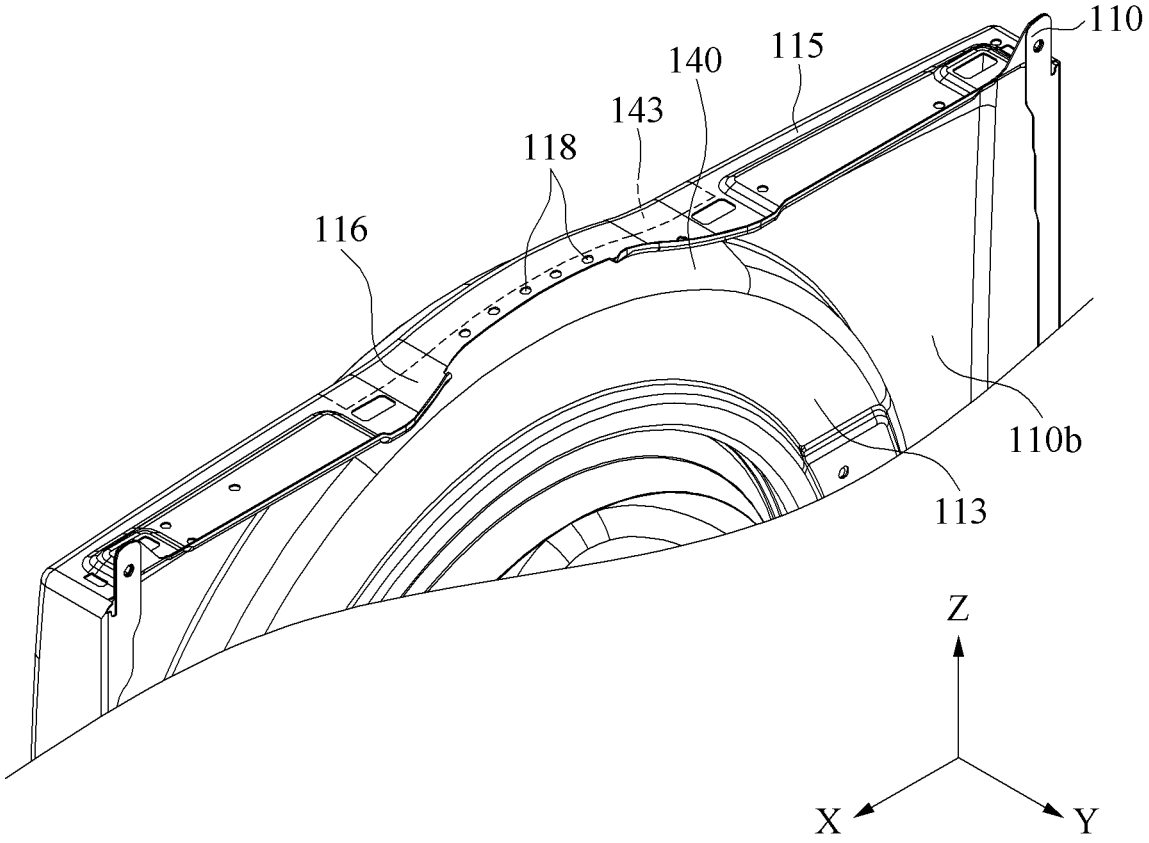
FIG. 7 is a perspective view of a partial area of a front panel according to one embodiment of the present disclosure.

FIG. 7 is a perspective view of a partial area of the front panel 110 according to one embodiment of the present disclosure.

Referring to FIG. 7, the front panel 110 in various embodiments may include a heat dissipating hole 118.

In one embodiment, the heat dissipating hole 118 may be formed in the nose 116 of the front panel 110. The heat dissipating hole 118 may be an open area to allow air between the nose 116 and the seating groove 113 to move to the outside. In various embodiments, a plurality of heat dissipating holes 118 may be provided and the plurality of heat dissipating holes 118 may be arranged in a row in both directions (e.g., the + and −X directions).

In one embodiment, when viewing the extended surface 115, an upper thermal insulating area (e.g., the upper thermal insulating area 143 of FIG. 5B) of the insulator 140 may be formed to not overlap the heat dissipating hole 118. For example, a hole that is open to correspond to the position and the shape of the heat dissipating hole 118 may be formed in the upper thermal insulating area 143 of the insulator 140. In one embodiment, in the heat dissipating hole 118, a predetermined gap from the upper side surface 140*d* of the insulator 140 may be formed on the outside.

In various embodiments, the heat dissipating hole 118 may discharge air between the nose 116 of the front panel 110 and the seating groove 113 to the outside and may prevent a partial area of the front panel 110 from overheating.

Figure 8A:
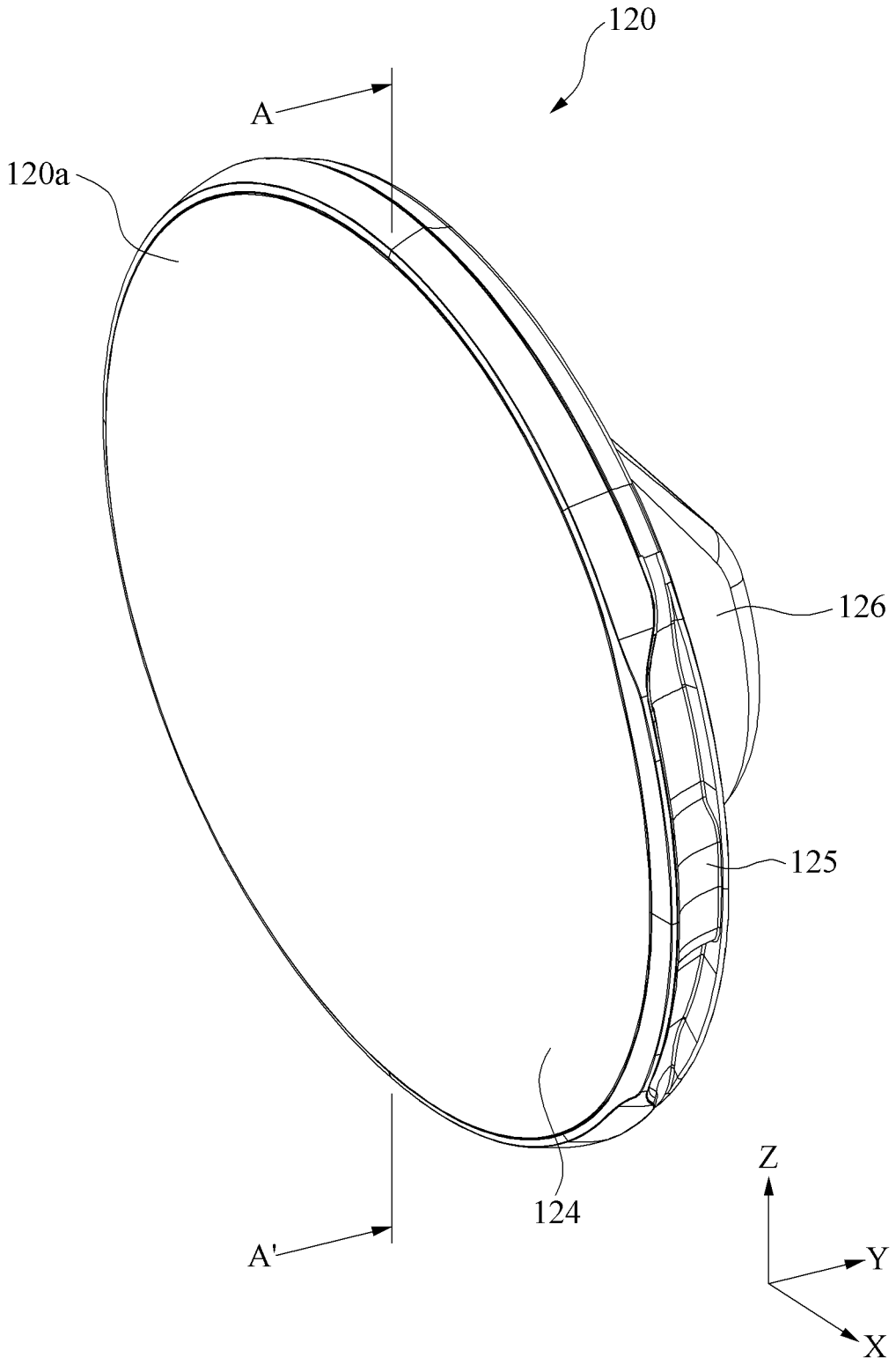
FIG. 8A is a perspective view of a door according to one embodiment of the present disclosure.
Figure 8B:
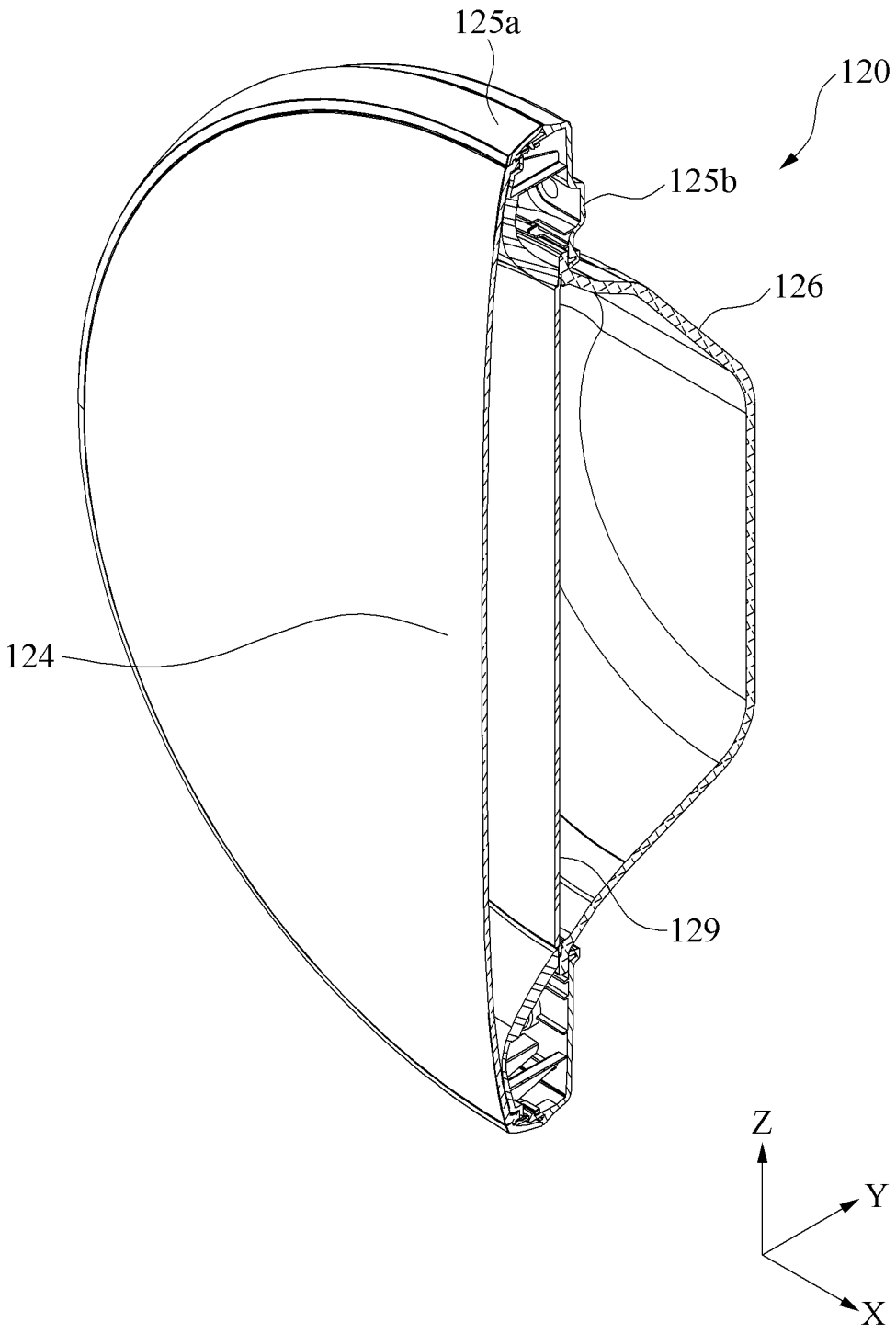
FIG. 8B is a cross-sectional view of a door according to one embodiment of the present disclosure.

FIG. 8A is a perspective view of the door 120 according to one embodiment of the present disclosure and FIG. 8B is a cross-sectional view of the door 120 according to one embodiment of the present disclosure. Specifically, FIG. 8B is a cross-sectional view of the door 120 in a direction (e.g., the −X direction) based on the line A-A' of FIG. 8A.

Referring to FIGS. 8A and 8B, the door 120 in various embodiments may include at least a portion of a frame 125 and a heat dissipating film 129.

In one embodiment, the frame 125 may form an external figure of the door 120 and may include a front frame 125*a* and a rear frame 125*b*. The front frame 125*a* may form the front surface 120*a* of the door 120 exposed to the outside of the clothing processing device 100 when the door 120 closes the opening 11.

In one embodiment, the front surface 120*a* of the front frame 125*a* may form a front surface 10*a* of the clothing processing device 100. The front frame 125*a* may include a window 124 formed of a transparent material to view the inside the drum 20 from the outside of the clothing processing device 100.

In one embodiment, the rear frame 125*b* may be disposed toward the inside the cabinet 10 when the door 120 closes the opening 11 and may be placed on the seating groove 113. The rear frame 125*b* may include a door glass 126 protruding toward the inside the cabinet 10.

In one embodiment, the heat dissipating film 129 may be disposed between the front frame 125*a* and the rear frame 125*b*. For example, the heat dissipating film 129 may be disposed between the window 124 and the door glass 126 and the heat dissipating film 129 may be formed of a transparent material. The heat dissipating film 129 may be disposed substantially in parallel with the window 124.

In one embodiment, the heat dissipating film 129 may block heat transfer to prevent heat transferred to the door glass 126 from being transferred to the front surface 120*a* of the door 120. For example, when performing a dry operation, hot air in the drum 20 may pass an inlet area (e.g., the inlet area of FIG. 2) of the drum 20 and may be transferred in the direction of the door glass 126 of the door 120, and thereby, the inside of the door 120 may be overheated. Since the front surface 120*a* of the door 120 is an area that a user may contact, when the front surface 120*a* of the door 120 is overheated, the user may be burned as the user touches the front surface 120*a* of the door 120, similarly to a case in which a partial area of the front panel 110 is overheated. In various embodiments, the heat dissipating film 129 may prevent heat from being transferred from the door glass 126 to the front surface 120*a* of the door 120 and may prevent the front surface 120*a* of the door 120 from overheating.

The clothing processing device 100 in various embodiments may include the cabinet 10, the front panel 110 including the first surface 110*a* that forms the front surface of the cabinet, the second surface 110*b* that is opposite to the first surface 110*a*, and the opening 11 that is open from the first surface 110*a* to the second surface 110*b*, the drum 20 disposed in the cabinet 10 and communicating with the opening 11, and the door 120 connected to the first surface 110*a* of the front panel 110 to open and close the opening 11, wherein the front panel 110 may include the seating groove 113 protruding toward the inside the cabinet 10 along the circumference of the opening 11 such that the door 120 is placed on the seating groove 113 when the door 120 closes the opening 11 and the extended surface 115 extending to the inside the cabinet 10 from the upper end 110*e* of the front panel 110, wherein the extended surface 115 may include the curved nose 116 while forming a gap with the seating groove 113, and wherein the clothing processing device 100 may include the insulator 140 disposed between the nose 116 and the seating groove 113 in the second surface 110*b* of the front panel 110 and the heat dissipating sheet 150 attached to the second surface 110*b* of the front panel 110 to enclose at least a portion of the circumference of the insulator 140.

In various embodiments, the heat dissipating sheet 150 may include the first sheet area 151 disposed between the insulator 140 and at least one of the left end 110*c* and the right end 110*d* of the second surface 110*b* when viewing the second surface 110*b*.

In various embodiments, the first sheet area 151 may include the first left sheet area 151*a* disposed between the insulator 140 and the left end 110*c* of the second surface 110*b* when viewing the second surface 110*b*, and the first right sheet area 151*b* disposed between the insulator 140 and the right end 110*d* of the second surface 110*b* when viewing the second surface 110*b*.

In various embodiments, one end of the first sheet area 151 may be substantially in contact with the insulator 140 when viewing the second surface 110*b*.

In various embodiments, the other end that is opposite to the one end of the first sheet area 151 may be substantially in contact with one of the left end 110*c* and the right end 110*d* of the second surface 110*b* when viewing the second surface 110*b*.

In various embodiments, the heat dissipating sheet 150 may include the second sheet area 152 disposed between the insulator 140 and the opening 11 to attach at least a partial area thereof to the seating groove 113 when viewing the second surface 110*b*.

In various embodiments, the second sheet area 152 may extend along the seating groove 113 to enclose at least a portion of the circumference of the opening 11.

In various embodiments, the seating groove 113 may include the flat portion 113*a* that is substantially flat and the inclined portion 113*b* that protrudes from the second surface 110*b* to connect to the flat portion when viewing the second surface 110*b*, and a second sheet area 152 may include the flat sheet portion 152*a* attached to the flat portion 113*a* and an inclined sheet portion 152*b* attached to the inclined portion 113*b*.

In various embodiments, the heat dissipating sheet 150 may include the third sheet area 153 disposed between the second sheet area 152 and at least one of the left end 110*c* and the right end 110*d* of the second surface 110*b* when viewing the second surface 110*b*.

In various embodiments, the third sheet area 153 may include the third left sheet area 153*a* disposed between the second sheet area 152 and the left end 110*c* of the second surface 110*b* when viewing the second surface 110*b* and the third right sheet area 153*b* disposed between the second sheet area 152 and the right end 110*d* of the second surface 110*b* when viewing the second surface 110*b*.

In various embodiments, the heat dissipating sheet 150 may include the first extended area 155 extending from at least one of the left end 110*c* and the right end 110*d* of the third sheet area 153 in the lower direction of the second surface 110*b* when viewing the second surface 110*b*.

In various embodiments, the heat dissipating sheet 150 may include the second extended area 156 extending from the first extended area 155 in a direction in which the opening 11 is enclosed when viewing the second surface 110*b*.

In various embodiments, the insulator 140 may include the first thermal insulating area 141 disposed on the second surface 110*b* to be substantially in parallel with the second surface 110*b* when viewing the second surface 110*b*, and the second thermal insulating area 142, 143 disposed on at least one of the seating groove 113 and the nose 116 when viewing the second surface 110*b*.

In various embodiments, the second thermal insulating area 142, 143 may include the upper thermal insulating area 143 disposed in the nose 116 and the lower thermal insulating area 142 disposed on the seating groove 113.

In various embodiments, the nose 116 may include the heat dissipating hole 118 to allow air between the nose 116 and the seating groove 113 to move to an outside, and the upper thermal insulating area 143 may be formed to not overlap the heat dissipating hole 118 when viewing the extended surface 115.

In various embodiments, the door 120 may include the front frame 125*a* forming the front surface 120*a*, the rear frame 125*b* forming the rear surface and including the door glass 126 protruding toward the inside the cabinet 10, and the heat dissipating film 129 disposed between the front frame 125*a* and the rear frame 125*b*.

In various embodiments, the heat dissipating sheet 150 may be formed of a thermally conductive material to diffuse heat between the nose 116 and the seating groove 113 to another area in the front panel 110.

In various embodiments, the heat dissipating sheet 150 may include a thermal conductive layer formed of a thermally conductive material and an adhesive layer that attaches the thermal conductive layer to the front panel 110.

In various embodiments, the heat dissipating sheet 150 may be formed in a multi-layer structure in which a plurality of thermal conductive layers is stacked.

In various embodiments, the insulator 140 may include is formed in a multi-layer structure in which a plurality of insulating layers formed of an insulating material is stacked.

Although desirable embodiments are illustrated and described above, the present disclosure is not limited to said certain embodiments, various applications may surely be performed by those skilled in the art without deviating from what is claimed in the scope of claims, and such applications should not be understood separately from the technical idea or prospects herein.

What is claimed is:

1. A clothing processing device comprising:
a cabinet;
a front panel comprising:
a first surface that forms a front surface of the cabinet;
a second surface that is opposite to the first surface; and
an opening formed therein and extending from the first surface to the second surface;
a drum disposed in the cabinet and to communicate with the opening; and
a door connected to the first surface of the front panel to open or close the opening,
wherein the front panel comprises:
a seating groove protruding toward an inside the cabinet along a circumference of the opening such that the door is placed on the seating groove in response to closing the opening by the door; and
an extended surface extending to the inside the cabinet from an upper end of the front panel, the extended surface comprising a curved nose to form a gap with the seating groove, and
wherein the clothing processing device further comprises:
an insulator disposed between the curved nose and the seating groove in the second surface of the front panel; and
a heat dissipating sheet attached to the second surface of the front panel to enclose at least a portion of the insulator along a circumference of the insulator.

2. The clothing processing device of claim 1,
wherein the heat dissipating sheet comprises:
a first sheet area disposed between the insulator, and
at least one of a left end of the second surface and a right end of the second surface.

3. The clothing processing device of claim 2,
wherein the first sheet area comprises:
a first left sheet area disposed between the insulator and the left end of the second surface, and
a first right sheet area disposed between the insulator and the right end of the second surface.

4. The clothing processing device of claim 2,
wherein one end of the first sheet area is substantially in contact with the insulator.

5. The clothing processing device of claim 4,
wherein another end that is opposite to the one end of the first sheet area is substantially in contact with one of the left end of the second surface and the right end of the second surface.

6. The clothing processing device of claim 1,
wherein the heat dissipating sheet comprises a second sheet area disposed between the insulator and the opening to attach at least a partial area of the second sheet area to the seating groove.

7. The clothing processing device of claim 6,
wherein the second sheet area extends along the seating groove to enclose at least a portion of the opening along the circumference of the opening.

8. The clothing processing device of claim 6,
wherein the seating groove comprises a flat portion that is substantially flat and an inclined portion that protrudes from the second surface to connect to the flat portion, and
the second sheet area comprises:
a flat sheet portion attached to the flat portion; and
an inclined sheet portion attached to the inclined portion.

9. The clothing processing device of claim 6,
wherein the heat dissipating sheet further comprises:
a third sheet area disposed between the second sheet area and at least one of a left end of the second surface and a right end of the second surface.

10. The clothing processing device of claim 9,
wherein the third sheet area comprises:
a third left sheet area disposed between the second sheet area and the left end of the second surface; and
a third right sheet area disposed between the second sheet area and the right end of the second surface.

11. The clothing processing device of claim 9,
wherein the heat dissipating sheet further comprises:
a first extended area extending from at least one of a left end of the third sheet area and a right end of the third sheet area in a lower direction of the second surface.

12. The clothing processing device of claim 11,
wherein the heat dissipating sheet further comprises:
a second extended area extending from the first extended area in a direction in which the opening is enclosed.

13. The clothing processing device of claim 1,
wherein the insulator comprises:
a first thermal insulating area disposed on the second surface to be substantially in parallel with the second surface; and
a second thermal insulating area disposed on at least one of the seating groove and the curved nose.

14. The clothing processing device of claim 13,
wherein the second thermal insulating area comprises:
an upper thermal insulating area disposed in the curved nose; and
a lower thermal insulating area disposed on the seating groove.

15. The clothing processing device of claim 14,
wherein the curved nose comprises a heat dissipating hole to allow air between the curved nose and the seating groove to move to an outside, and the upper thermal insulating area is formed not to overlap the heat dissipating hole.

16. The clothing processing device of claim 1,
wherein the door comprises:
a front frame forming a front surface;
a rear frame forming a rear surface, the rear frame comprising:
a door glass protruding toward the inside the cabinet; and
a heat dissipating film disposed between the front frame and the rear frame.

17. The clothing processing device of claim 1,
wherein the heat dissipating sheet is formed of a thermally conductive material to diffuse heat between the curved nose and the seating groove to another area in the front panel.

18. The clothing processing device of claim 1,
wherein the heat dissipating sheet comprises:
a thermal conductive layer formed of a thermally conductive material; and
an adhesive layer that attaches the thermal conductive layer to the front panel.

19. The clothing processing device of claim 18,
wherein the heat dissipating sheet is formed in a multilayer structure in which a plurality of thermal conductive layers is stacked.

20. The clothing processing device of claim 1, wherein the insulator is formed in a multi-layer structure in which a plurality of insulating layers formed of an insulating material is stacked.

* * * * *